US010699648B2

(12) United States Patent
Chaji

(10) Patent No.: US 10,699,648 B2
(45) Date of Patent: Jun. 30, 2020

(54) SYSTEM AND METHODS FOR EXTRACTING CORRELATION CURVES FOR AN ORGANIC LIGHT EMITTING DEVICE

(71) Applicant: Ignis Innovation Inc., Waterloo (CA)

(72) Inventor: Gholamreza Chaji, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 0 days.

(21) Appl. No.: 16/193,605

(22) Filed: Nov. 16, 2018

(65) Prior Publication Data

US 2019/0088211 A1 Mar. 21, 2019

Related U.S. Application Data

(63) Continuation of application No. 15/198,981, filed on Jun. 30, 2016, now Pat. No. 10,163,401, which is a continuation-in-part of application No. 14/590,105, filed on Jan. 6, 2015, now Pat. No. 10,089,921, which is a continuation-in-part of application No. 14/322,443, filed on Jul. 2, 2014, now abandoned, which is a continuation-in-part of application No. 14/314,514, filed on Jun. 25, 2014, now Pat. No.

(Continued)

(30) Foreign Application Priority Data

| | | |
|---|---|---|
| Feb. 4, 2010 | (CA) | 2692097 |
| Jun. 30, 2015 | (CA) | 2896018 |
| Jul. 13, 2015 | (CA) | 2896902 |

(51) Int. Cl.
*G09G 3/3291* (2016.01)

(52) U.S. Cl.
CPC ... *G09G 3/3291* (2013.01); *G09G 2300/0413* (2013.01); *G09G 2320/029* (2013.01); *G09G 2320/0285* (2013.01); *G09G 2320/043* (2013.01); *G09G 2360/145* (2013.01)

(58) Field of Classification Search
USPC ..... 345/690
See application file for complete search history.

(56) References Cited

U.S. PATENT DOCUMENTS

| | | | | |
|---|---|---|---|---|
| 7,355,574 B1 * | 4/2008 | Leon | ..... | G09G 3/3233 345/101 |
| 2003/0107565 A1 * | 6/2003 | Libsch | ..... | G09G 3/3233 345/211 |

(Continued)

*Primary Examiner* — Chineyere D Wills-Burns
(74) *Attorney, Agent, or Firm* — Stratford Managers Corporation

(57) ABSTRACT

A method of compensating for efficiency degradation of an OLED in an array-based semiconductor device having arrays of pixels that include OLEDs, including determining for a plurality of operating conditions interdependency curves relating changes in an electrical operating parameter of said OLEDs and the efficiency degradation of said OLEDs, the plurality of operating conditions can include temperature or initial device characteristics as well as stress conditions to more completely determine interdependency curves for a wide variety of OLEDs. In some cases interdependency curves are updated remotely after fabrication of the array-based device. Some embodiments utilize degradation-time curves and methods which do not require storage of stress history.

19 Claims, 20 Drawing Sheets

Related U.S. Application Data

10,176,736, which is a continuation-in-part of application No. 14/286,711, filed on May 23, 2014, now Pat. No. 9,881,532, which is a continuation-in-part of application No. 14/027,811, filed on Sep. 16, 2013, now Pat. No. 9,430,958, which is a continuation of application No. 13/020,252, filed on Feb. 3, 2011, now Pat. No. 8,589,100.

(60) Provisional application No. 62/280,457, filed on Jan. 19, 2016, provisional application No. 62/280,498, filed on Jan. 19, 2016.

(56) References Cited

U.S. PATENT DOCUMENTS

| | | | | |
|---|---|---|---|---|
| 2005/0110420 | A1* | 5/2005 | Arnold | G09G 3/3225 315/169.3 |
| 2005/0270204 | A1* | 12/2005 | Zhang | G09G 3/3275 341/144 |
| 2005/0270537 | A1* | 12/2005 | Mian | G01N 21/538 356/437 |
| 2006/0056082 | A1* | 3/2006 | Hung | H04N 5/217 359/819 |
| 2006/0139254 | A1* | 6/2006 | Hayakawa | G09G 3/3216 345/76 |
| 2007/0290958 | A1* | 12/2007 | Cok | G09G 3/3225 345/77 |
| 2008/0042943 | A1* | 2/2008 | Cok | G09G 3/3225 345/77 |
| 2008/0088648 | A1* | 4/2008 | Nathan | H05B 45/60 345/690 |
| 2011/0084701 | A1* | 4/2011 | Bancken | H05B 45/37 324/414 |

* cited by examiner

SYSTEM AND METHODS FOR EXTRACTING CORRELATION CURVES FOR AN ORGANIC LIGHT EMITTING DEVICE

CROSS-REFERENCE TO RELATED APPLICATIONS

The present application is a continuation of U.S. patent application Ser. No. 15/198,981, now allowed, which is a continuation-in-part of and claims priority to U.S. patent application Ser. No. 14/590,105, filed Jan. 6, 2015, now U.S. Pat. No. 10,089,921, which is a continuation-in-part of U.S. patent application Ser. No. 14/322,443, filed Jul. 2, 2014, now abandoned, which is a continuation-in-part of U.S. patent application Ser. No. 14/314,514, filed Jun. 25, 2014, now abandoned, which is a continuation-in-part of U.S. patent application Ser. No. 14/286,711, filed May 23, 2014, now U.S. Pat. No. 9,881,532 which is a continuation-in-part of U.S. patent application Ser. No. 14/027,811, filed Sep. 16, 2013, now U.S. Pat. No. 9,430,958, which is a continuation of U.S. patent application Ser. No. 13/020,252, filed Feb. 3, 2011, now U.S. Pat. No. 8,589,100, which claims priority to Canadian Application No. 2,692,097, filed Feb. 4, 2010, now abandoned, and the present application also claims priority to Canadian Application No. 2,896,018, filed Jun. 30, 2015, Canadian Application No. 2,896,902, filed Jul. 13, 2015, U.S. Provisional Application No. 62/280,457, filed Jan. 19, 2016 and U.S. Provisional Application No. 62/280,498, filed Jan. 19, 2016, each of which is hereby incorporated by reference herein in its entirety.

FIELD OF THE INVENTION

This invention is directed generally to displays that use light emissive devices such as OLEDs and, more particularly, to extracting characterization correlation curves under different stress conditions in such displays to compensate for aging of the light emissive devices.

BACKGROUND

Active matrix organic light emitting device ("AMOLED") displays offer the advantages of lower power consumption, manufacturing flexibility, and faster refresh rate over conventional liquid crystal displays. In contrast to conventional liquid crystal displays, there is no backlighting in an AMOLED display as each pixel consists of different colored OLEDs emitting light independently. The OLEDs emit light based on current supplied through a drive transistor. The drive transistor is typically a thin film transistor (TFT). The power consumed in each pixel has a direct relation with the magnitude of the generated light in that pixel.

During operation of an organic light emitting diode device, it undergoes degradation, which causes light output at a constant current to decrease over time. The OLED device also undergoes an electrical degradation, which causes the current to drop at a constant bias voltage over time. These degradations are caused primarily by stress related to the magnitude and duration of the applied voltage on the OLED and the resulting current passing through the device. Such degradations are compounded by contributions from the environmental factors such as temperature, humidity, or presence of oxidants over time. The aging rate of the thin film transistor devices is also environmental and stress (bias) dependent. The aging of the drive transistor and the OLED may be properly determined via calibrating the pixel against stored historical data from the pixel at previous times to determine the aging effects on the pixel. Accurate aging data is therefore necessary throughout the lifetime of the display device.

In one compensation technique for OLED displays, the aging (and/or uniformity) of a panel of pixels is extracted and stored in lookup tables as raw or processed data. Then a compensation module uses the stored data to compensate for any shift in electrical and optical parameters of the OLED (e.g., the shift in the OLED operating voltage and the optical efficiency) and the backplane (e.g., the threshold voltage shift of the TFT), hence the programming voltage of each pixel is modified according to the stored data and the video content. The compensation module modifies the bias of the driving TFT in a way that the OLED passes enough current to maintain the same luminance level for each gray-scale level. In other words, a correct programming voltage properly offsets the electrical and optical aging of the OLED as well as the electrical degradation of the TFT.

The electrical parameters of the backplane TFTs and OLED devices are continuously monitored and extracted throughout the lifetime of the display by electrical feedback-based measurement circuits. Further, the optical aging parameters of the OLED devices are estimated from the OLED's electrical degradation data. However, the optical aging effect of the OLED is dependent on the stress conditions placed on individual pixels as well, and since the stresses vary from pixel to pixel, accurate compensation is not assured unless the compensation tailored for a specific stress level is determined.

There is therefore a need for efficient extraction of characterization correlation curves of the optical and electrical parameters that are accurate for stress conditions on active pixels for compensation for aging and other effects. There is also a need for having a variety of characterization correlation curves for a variety of stress conditions that the active pixels may be subjected to during operation of the display. There is a further need for accurate compensation systems for pixels in an organic light emitting device based display.

SUMMARY

In accordance with one aspect, there is provided a method of compensating for efficiency degradation of an organic light emitting device (OLED) in an array-based semiconductor device having arrays of pixels that include OLEDs, said method comprising: determining for a plurality of operating conditions interdependency curves relating changes in an electrical operating parameter of said OLEDs and the efficiency degradation of said OLEDs in said array-based semiconductor device, the plurality of operating conditions comprising at least two operating condition types; determining at least one operation condition for the OLED in respect of the at least two operating condition types; measuring the electrical operating parameter of said OLED; determining an efficiency degradation of said OLED using said interdependency curves, said at least one operation condition for the OLED, and said measured electrical operating parameter; determining a correction factor for the OLED with use of said efficiency degradation; and compensating for said efficiency degradation with use of said correction factor.

In some embodiments, the at least two operating condition types comprise a temperature condition and a stress condition, and the at least one operation condition for the OLED comprises a temperature history and a stress history.

In some embodiments, each interdependency curve has an associated temperature condition and a stress condition, and wherein determining an efficiency degradation comprises: determining at least one temperature associated interdependency curve with use of said temperature history; and determining from said at least one temperature associated interdependency curve and said stress history and said measured electrical operating parameter, the efficiency degradation of the OLED.

In some embodiments each interdependency curve has an associated effective stress history as a function of at least the temperature condition and a stress condition, and wherein determining an efficiency degradation comprises: determining an effective stress history for the OLED with use of the temperature history and the stress history; and determining from said interdependency curves and said effective stress history and said measured electrical operating parameter the efficiency degradation of the OLED.

In some embodiments, after the correction factor for the OLED has been determined, a start point associated with the interdependency curves is reset.

In some embodiments, the at least two operating condition types comprise a temperature condition and an initial device characteristic condition, and the at least one operation condition for the OLED comprises a temperature history and initial device characteristics.

In some embodiments, each interdependency curve has an associated initial device characteristic condition and a stress condition, and wherein determining an efficiency degradation comprises: determining at least one initial device characteristic associated interdependency curve with use of said initial device characteristics; and determining from said at least one initial device characteristic associated interdependency curve and said stress history and said measured electrical operating parameter, the efficiency degradation of the OLED.

In some embodiments, determining for a plurality of operating conditions interdependency curves comprises: extracting initial characteristics for each of a plurality of test OLEDs; repeatedly subjecting the test OLEDs to different stress conditions until all test OLEDs are measured; and extracting interdependency curves for said test OLEDs and storing said interdependency curves such that each interdependency curve is associated with at least one stress condition and an initial device characteristic condition.

Some embodiments further provide for updating remotely a set of interdependency curves stored with the array-based semiconductor device with a set of prepared interdependency curves from a remote interdependency curve library at least twice after fabrication of the array-based semiconductor device.

In some embodiments the updating remotely occurs at the time of at least two of: shipping the array-based semiconductor device to the manufacturer, integrating the array-based semiconductor device into a product, and operation of the array-based semiconductor device at a consumer site.

In some embodiments, determining the efficiency degradation comprises: initializing a total effective stress time value; sampling brightness data for said OLED; calculating an effective stress time corresponding to said sampling for at least one given reference stress level; updating the total effective stress time for said OLED based on the at least one given stress level; determining whether to sample more brightness data; and in a case no more brightness data are to be sampled, updating the efficiency degradation with use of the total effective stress, and the interdependency curves.

In some embodiments, determining whether to sample more brightness data comprises comparing the total effective stress time with a predetermined threshold.

In some embodiments, determining the efficiency degradation comprises: initializing a total change in degradation factor; sampling brightness data for said OLED; calculating a change in degradation corresponding to the sampled brightness; updating the total change in degradation factor for said OLED; determining whether to sample more brightness data; and in a case no more brightness data are to be sampled, updating the efficiency degradation with use of the total change in degradation factor, and the interdependency curves.

In some embodiments, determining whether to sample more brightness data comprises comparing the total change in degradation factor with a predetermined change in degradation threshold.

In accordance with another aspect, there is provided a method of compensating for efficiency degradation of an organic light emitting device (OLED) in an array-based semiconductor device having arrays of pixels that include OLEDs, said method comprising: determining for a plurality of operating conditions at least one degradation-time curve relating changes in a stress time parameter associated with said OLEDs and the efficiency degradation of said OLEDs in said array-based semiconductor device, the plurality of operating stress conditions comprising at least two operating stress condition types; measuring at least one operating stress condition for the OLED in respect of the at least two operating stress condition types; determining an efficiency degradation of said OLED using said at least one degradation-time curve, and said at least one operating stress condition for the OLED; determining a correction factor for the OLED with use of said efficiency degradation; and compensating for said efficiency degradation with use of said correction factor.

In some embodiments, after the correction factor for the OLED has been determined, a start point associated with the at least one degradation-time curve is reset.

In some embodiments, determining the efficiency degradation comprises: initializing a total effective stress time value; sampling brightness data for said OLED; calculating an effective stress time corresponding to said sampling for at least one given reference stress level; updating the total effective stress time for said OLED based on the at least one given stress level; determining whether to sample more brightness data; and in a case no more brightness data are to be sampled, updating the efficiency degradation with use of the total effective stress, and the at least one degradation-time curve.

In some embodiments, determining the efficiency degradation comprises: initializing a total change in degradation factor; sampling brightness data for said OLED; calculating a change in degradation corresponding to the sampled brightness; updating the total change in degradation factor for said OLED; determining whether to sample more brightness data; and in a case no more brightness data are to be sampled, updating the efficiency degradation with use of the total change in degradation factor, and the at least one degradation-time curve.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings.

Figure 1:
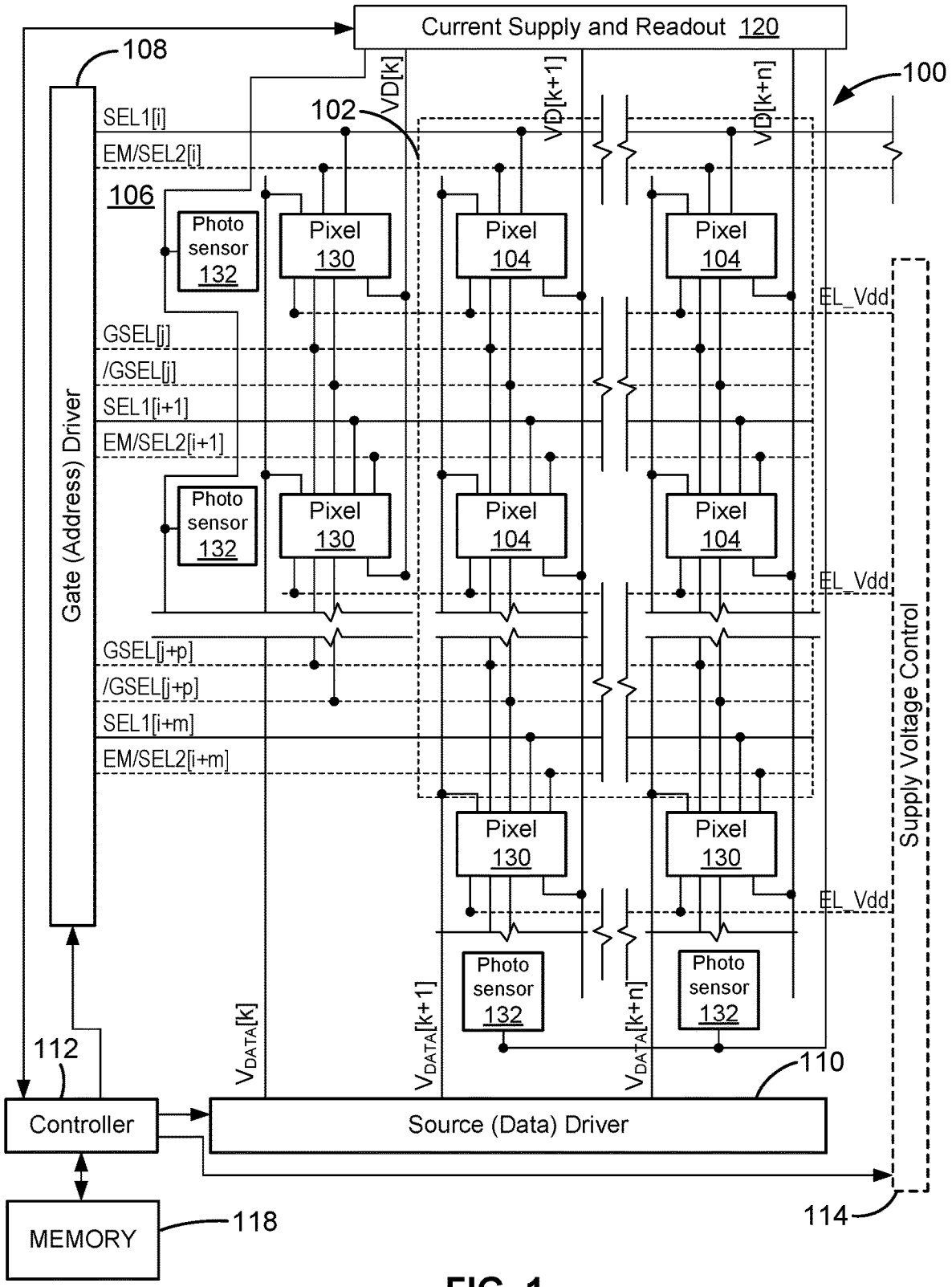
FIG. 1 is a block diagram of an AMOLED display system with compensation control.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

FIG. 1 is an electronic display system 100 having an active matrix area or pixel array 102 in which an array of active pixels 104 are arranged in a row and column configuration. For ease of illustration, only two rows and columns are shown. External to the active matrix area, which is the pixel array 102, is a peripheral area 106 where peripheral circuitry for driving and controlling the area of the pixel array 102 are disposed. The peripheral circuitry includes a gate or address driver circuit 108, a source or data driver circuit 110, a controller 112, and an optional supply voltage (e.g., EL_Vdd) driver 114. The controller 112 controls the gate, source, and supply voltage drivers 108, 110, 114. The gate driver 108, under control of the controller 112, operates on address or select lines SEL[i], SEL[i+1], and so forth, one for each row of pixels 104 in the pixel array 102. In pixel sharing configurations described below, the gate or address driver circuit 108 can also optionally operate on global select lines GSEL[j] and optionally/GSEL[j], which operate on multiple rows of pixels 104 in the pixel array 102, such as every two rows of pixels 104. The source driver circuit 110, under control of the controller 112, operates on voltage data lines Vdata[k], Vdata[k+1], and so forth, one for each column of pixels 104 in the pixel array 102. The voltage data lines carry voltage programming information to each pixel 104 indicative of brightness of each light emitting device in the pixel 104. A storage element, such as a capacitor, in each pixel 104 stores the voltage programming information until an emission or driving cycle turns on the light emitting device. The optional supply voltage driver 114, under control of the controller 112, controls a supply voltage (EL_Vdd) line, one for each row of pixels 104 in the pixel array 102. The controller 112 is also coupled to a memory 118 that stores various characterization correlation curves and aging parameters of the pixels 104 as will be explained below. The memory 118 may be one or more of a flash memory, an SRAM, a DRAM, combinations thereof, and/or the like.

The display system 100 may also include a current source circuit, which supplies a fixed current on current bias lines.

In some configurations, a reference current can be supplied to the current source circuit. In such configurations, a current source control controls the timing of the application of a bias current on the current bias lines. In configurations in which the reference current is not supplied to the current source circuit, a current source address driver controls the timing of the application of a bias current on the current bias lines.

As is known, each pixel 104 in the display system 100 needs to be programmed with information indicating the brightness of the light emitting device in the pixel 104. A frame defines the time period that includes a programming cycle or phase during which each and every pixel in the display system 100 is programmed with a programming voltage indicative of a brightness and a driving or emission cycle or phase during which each light emitting device in each pixel is turned on to emit light at a brightness commensurate with the programming voltage stored in a storage element. A frame is thus one of many still images that compose a complete moving picture displayed on the display system 100. There are at least two schemes for programming and driving the pixels: row-by-row, or frame-by-frame. In row-by-row programming, a row of pixels is programmed and then driven before the next row of pixels is programmed and driven. In frame-by-frame programming, all rows of pixels in the display system 100 are programmed first, and all of the frames are driven row-by-row. Either scheme can employ a brief vertical blanking time at the beginning or end of each period during which the pixels are neither programmed nor driven.

The components located outside of the pixel array 102 may be disposed in a peripheral area 106 around the pixel array 102 on the same physical substrate on which the pixel array 102 is disposed. These components include the gate driver 108, the source driver 110, and the optional supply voltage control 114. Alternately, some of the components in the peripheral area can be disposed on the same substrate as the pixel array 102 while other components are disposed on a different substrate, or all of the components in the peripheral area can be disposed on a substrate different from the substrate on which the pixel array 102 is disposed. Together, the gate driver 108, the source driver 110, and the supply voltage control 114 make up a display driver circuit. The display driver circuit in some configurations may include the gate driver 108 and the source driver 110 but not the supply voltage control 114.

The display system 100 further includes a current supply and readout circuit 120, which reads output data from data output lines, VD [k], VD [k+1], and so forth, one for each column of active pixels 104 in the pixel array 102. A set of optional reference devices such as reference pixels 130 is fabricated on the edge of the pixel array 102 outside the active pixels 104 in the peripheral area 106. The reference pixels 130 also may receive input signals from the controller 112 and may output data signals to the current supply and readout circuit 120. The reference pixels 130 include the drive transistor and an OLED but are not part of the pixel array 102 that displays images. As will be explained below, different groups of reference pixels 130 are placed under different stress conditions via different current levels from the current supply circuit 120. Because the reference pixels 130 are not part of the pixel array 102 and thus do not display images, the reference pixels 130 may provide data indicating the effects of aging at different stress conditions. Although only one row and column of reference pixels 130 is shown in FIG. 1, it is to be understood that there may be any number of reference pixels. Each of the reference pixels 130 in the example shown in FIG. 1 are fabricated next to a corresponding photo sensor 132. The photo sensor 132 is used to determine the luminance level emitted by the corresponding reference pixel 130. It is to be understood that reference devices such as the reference pixels 130 may be a stand alone device rather than being fabricated on the display with the active pixels 104.

Figure 2:
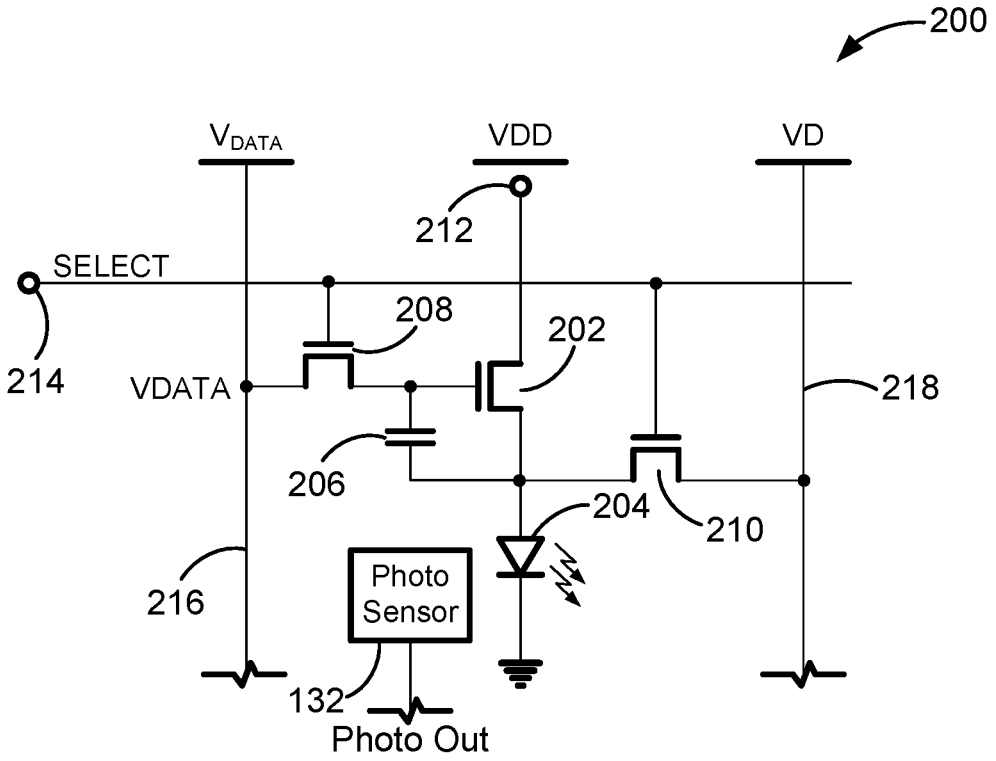
FIG. 2 is a circuit diagram of one of the reference pixels in FIG. 1 for modifying characterization correlation curves based on the measured data.

FIG. 2 shows one example of a driver circuit 200 for one of the example reference pixels 130 in FIG. 1. The driver circuit 200 of the reference pixel 130 includes a drive transistor 202, an organic light emitting device ("OLED") 204, a storage capacitor 206, a select transistor 208 and a monitoring transistor 210. A voltage source 212 is coupled to the drive transistor 202. As shown in FIG. 2, the drive transistor 202 is a thin film transistor in this example that is fabricated from amorphous silicon. A select line 214 is coupled to the select transistor 208 to activate the driver circuit 200. A voltage programming input line 216 allows a programming voltage to be applied to the drive transistor 202. A monitoring line 218 allows outputs of the OLED 204 and/or the drive transistor 202 to be monitored. The select line 214 is coupled to the select transistor 208 and the monitoring transistor 210. During the readout time, the select line 214 is pulled high. A programming voltage may be applied via the programming voltage input line 216. A monitoring voltage may be read from the monitoring line 218 that is coupled to the monitoring transistor 210. The signal to the select line 214 may be sent in parallel with the pixel programming cycle.

The reference pixel 130 may be stressed at a certain current level by applying a constant voltage to the programming voltage input line 216. As will be explained below, the voltage output measured from the monitoring line 218 based on a reference voltage applied to the programming voltage input line 216 allows the determination of electrical characterization data for the applied stress conditions over the time of operation of the reference pixel 130. Alternatively, the monitor line 218 and the programming voltage input line 216 may be merged into one line (i.e., Data/Mon) to carry out both the programming and monitoring functions through that single line. The output of the photo-sensor 132 allows the determination of optical characterization data for stress conditions over the time of operation for the reference pixel 130.

The display system 100 in FIG. 1, according to one exemplary embodiment, in which the brightness of each pixel (or subpixel) is adjusted based on the aging of at least one of the pixels, to maintain a substantially uniform display over the operating life of the system (e.g., 75,000 hours). Non-limiting examples of display devices incorporating the display system 100 include a mobile phone, a digital camera, a personal digital assistant (PDA), a computer, a television, a portable video player, a global positioning system (GPS), etc.

As the OLED material of an active pixel 104 ages, the voltage required to maintain a constant current for a given level through the OLED increases. To compensate for electrical aging of the OLEDs, the memory 118 stores the required compensation voltage of each active pixel to maintain a constant current. It also stores data in the form of characterization correlation curves for different stress conditions that is utilized by the controller 112 to determine compensation voltages to modify the programming voltages to drive each OLED of the active pixels 104 to correctly display a desired output level of luminance by increasing the OLED's current to compensate for the optical aging of the OLED. In particular, the memory 118 stores a plurality of predefined characterization correlation curves or functions, which represent the degradation in luminance efficiency for OLEDs operating under different predetermined stress conditions. The different predetermined stress conditions generally represent different types of stress or operating conditions that an active pixel 104 may undergo during the lifetime of the pixel. Different stress conditions may include constant current requirements at different levels from low to high, constant luminance requirements from low to high, or a mix of two or more stress levels. For example, the stress levels may be at a certain current for some percentage of the time and another current level for another percentage of the time. Other stress levels may be specialized such as a level representing an average streaming video displayed on the display system 100. Initially, the base line electrical and optical characteristics of the reference devices such as the reference pixels 130 at different stress conditions are stored in the memory 118. In this example, the baseline optical characteristic and the baseline electrical characteristic of the reference device are measured from the reference device immediately after fabrication of the reference device.

Each such stress condition may be applied to a group of reference pixels such as the reference pixels 130 by maintaining a constant current through the reference pixel 130 over a period of time, maintaining a constant luminance of the reference pixel 130 over a period of time, and/or varying the current through or luminance of the reference pixel at different predetermined levels and predetermined intervals over a period of time. The current or luminance level(s) generated in the reference pixel 130 can be, for example, high values, low values, and/or average values expected for the particular application for which the display system 100 is intended. For example, applications such as a computer monitor require high values. Similarly, the period(s) of time for which the current or luminance level(s) are generated in the reference pixel may depend on the particular application for which the display system 100 is intended.

It is contemplated that the different predetermined stress conditions are applied to different reference pixels 130 during the operation of the display system 100 in order to replicate aging effects under each of the predetermined stress conditions. In other words, a first predetermined stress condition is applied to a first set of reference pixels, a second predetermined stress condition is applied to a second set of reference pixels, and so on. In this example, the display system 100 has groups of reference pixels 130 that are stressed under 16 different stress conditions that range from a low current value to a high current value for the pixels. Thus, there are 16 different groups of reference pixels 130 in this example. Of course, greater or lesser numbers of stress conditions may be applied depending on factors such as the desired accuracy of the compensation, the physical space in the peripheral area 106, the amount of processing power available, and the amount of memory for storing the characterization correlation curve data.

By continually subjecting a reference pixel or group of reference pixels to a stress condition, the components of the reference pixel are aged according to the operating conditions of the stress condition. As the stress condition is applied to the reference pixel during the operation of the system 100, the electrical and optical characteristics of the reference pixel are measured and evaluated to determine data for determining correction curves for the compensation of aging in the active pixels 104 in the array 102. In this example, the optical characteristics and electrical characteristics are measured once an hour for each group of reference pixels 130. The corresponding characteristic correlation curves are therefore updated for the measured characteristics of the reference pixels 130. Of course, these measurements may be made in shorter periods of time or for longer periods of time depending on the accuracy desired for aging compensation.

Generally, the luminance of the OLED 204 has a direct linear relationship with the current applied to the OLED 204. The optical characteristic of an OLED may be expressed as:

$$L=O*I$$

In this equation, luminance, L, is a result of a coefficient, O, based on the properties of the OLED multiplied by the current I. As the OLED 204 ages, the coefficient O decreases and therefore the luminance decreases for a constant current value. The measured luminance at a given current may therefore be used to determine the characteristic change in the coefficient, O, due to aging for a particular OLED 204 at a particular time for a predetermined stress condition.

The measured electrical characteristic represents the relationship between the voltage provided to the drive transistor 202 and the resulting current through the OLED 204. For example, the change in voltage required to achieve a constant current level through the OLED of the reference pixel may be measured with a voltage sensor or thin film transistor such as the monitoring transistor 210 in FIG. 2. The required voltage generally increases as the OLED 204 and drive transistor 202 ages. The required voltage has a power law relation with the output current as shown in the following equation $$I=k*(V-e)^a$$

In this equation, the current is determined by a constant, k, multiplied by the input voltage, V, minus a coefficient, e, which represents the electrical characteristics of the drive transistor 202. The voltage therefore has a power law relation by the variable, a, to the current, I. As the transistor 202 ages, the coefficient, e, increases thereby requiring greater voltage to produce the same current. The measured current from the reference pixel may therefore be used to determine the value of the coefficient, e, for a particular reference pixel at a certain time for the stress condition applied to the reference pixel.

As explained above, the optical characteristic, O, represents the relationship between the luminance generated by the OLED 204 of the reference pixel 130 as measured by the photo sensor 132 and the current through the OLED 204 in FIG. 2. The measured electrical characteristic, e, represents the relationship between the voltage applied and the resulting current. The change in luminance of the reference pixel 130 at a constant current level from a baseline optical characteristic may be measured by a photo sensor such as the photo sensor 132 in FIG. 1 as the stress condition is applied to the reference pixel. The change in electric characteristics, e, from a baseline electrical characteristic may be measured from the monitoring line to determine the current output. During the operation of the display system 100, the stress condition current level is continuously applied to the reference pixel 130. When a measurement is desired, the stress condition current is removed and the select line 214 is activated. A reference voltage is applied and the resulting luminance level is taken from the output of the photo sensor 132 and the output voltage is measured from the monitoring line 218. The resulting data is compared with previous optical and electrical data to determine changes in current and luminance outputs for a particular stress condition from aging to update the characteristics of the reference pixel at the stress condition. The updated characteristics data is used to update the characteristic correlation curve.

Then by using the electrical and optical characteristics measured from the reference pixel, a characterization correlation curve (or function) is determined for the predetermined stress condition over time. The characterization correlation curve provides a quantifiable relationship between the optical degradation and the electrical aging expected for a given pixel operating under the stress condition. More particularly, each point on the characterization correlation curve determines the correlation between the electrical and optical characteristics of an OLED of a given pixel under the stress condition at a given time where measurements are taken from the reference pixel 130. The characteristics may then be used by the controller 112 to determine appropriate compensation voltages for active pixels 104 that have been aged under the same stress conditions as applied to the reference pixels 130. In another example, the baseline optical characteristic may be periodically measured from a base OLED device at the same time as the optical characteristic of the OLED of the reference pixel is being measured. The base OLED device either is not being stressed or being stressed on a known and controlled rate. This will eliminate any environmental effect on the reference OLED characterization.

Due to manufacturing processes and other factors known to those skilled in the art, each reference pixel 130 of the display system 100 may not have uniform characteristics, resulting in different emitting performances. One technique is to average the values for the electrical characteristics and the values of the luminance characteristics obtained by a set of reference pixels under a predetermined stress condition. A better representation of the effect of the stress condition on an average pixel is obtained by applying the stress condition to a set of the reference pixels 130 and applying a polling-averaging technique to avoid defects, measurement noise, and other issues that can arise during application of the stress condition to the reference pixels. For example, faulty values such as those determined due to noise or a dead reference pixel may be removed from the averaging. Such a technique may have predetermined levels of luminance and electrical characteristics that must be met before inclusion of those values in the averaging. Additional statistical regression techniques may also be utilized to provide less weight to electrical and optical characteristic values that are significantly different from the other measured values for the reference pixels under a given stress condition.

In this example, each of the stress conditions is applied to a different set of reference pixels. The optical and electrical characteristics of the reference pixels are measured, and a polling-averaging technique and/or a statistical regression technique are applied to determine different characterization correlation curves corresponding to each of the stress conditions. The different characterization correlation curves are stored in the memory 118. Although this example uses reference devices to determine the correlation curves, the correlation curves may be determined in other ways such as from historical data or predetermined by a manufacturer.

During the operation of the display system 100, each group of the reference pixels 130 may be subjected to the respective stress conditions and the characterization correlation curves initially stored in the memory 118 may be updated by the controller 112 to reflect data taken from the reference pixels 130 that are subject to the same external conditions as the active pixels 104. The characterization correlation curves may thus be tuned for each of the active pixels 104 based on measurements made for the electrical and luminance characteristics of the reference pixels 130 during operation of the display system 100. The electrical and luminance characteristics for each stress condition are therefore stored in the memory 118 and updated during the operation of the display system 100. The storage of the data may be in a piecewise linear model. In this example, such a piecewise linear model has 16 coefficients that are updated as the reference pixels 130 are measured for voltage and luminance characteristics. Alternatively, a curve may be determined and updated using linear regression or by storing data in a look up table in the memory 118.

To generate and store a characterization correlation curve for every possible stress condition would be impractical due to the large amount of resources (e.g., memory storage, processing power, etc.) that would be required. The disclosed display system 100 overcomes such limitations by determining and storing a discrete number of characterization correlation curves at predetermined stress conditions and subsequently combining those predefined characterization correlation curves using linear or nonlinear algorithm(s) to synthesize a compensation factor for each pixel 104 of the display system 100 depending on the particular operating condition of each pixel. As explained above, in this example there are a range of 16 different predetermined stress conditions and therefore 16 different characterization correlation curves stored in the memory 118.

For each pixel 104, the display system 100 analyzes the stress condition being applied to the pixel 104, and determines a compensation factor using an algorithm based on the predefined characterization correlation curves and the measured electrical aging of the panel pixels. The display system 100 then provides a voltage to the pixel based on the compensation factor. The controller 112 therefore determines the stress of a particular pixel 104 and determines the closest two predetermined stress conditions and attendant characteristic data obtained from the reference pixels 130 at those predetermined stress conditions for the stress condition of the particular pixel 104. The stress condition of the active pixel 104 therefore falls between a low predetermined stress condition and a high predetermined stress condition.

The following examples of linear and nonlinear equations for combining characterization correlation curves are described in terms of two such predefined characterization correlation curves for ease of disclosure; however, it is to be understood that any other number of predefined characterization correlation curves can be utilized in the exemplary techniques for combining the characterization correlation curves. The two exemplary characterization correlation curves include a first characterization correlation curve determined for a high stress condition and a second characterization correlation curve determined for a low stress condition.

Figure 3:
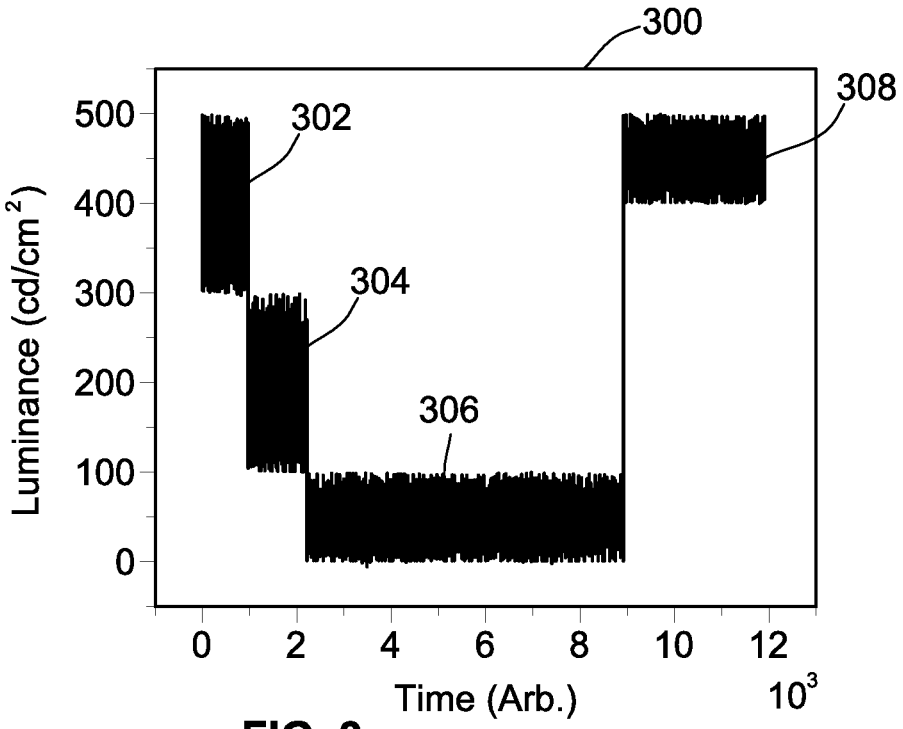
FIG. 3 is a graph of luminance emitted from an active pixel reflecting the different levels of stress conditions over time that may require different compensation.

The ability to use different characterization correlation curves over different levels provides accurate compensation for active pixels 104 that are subjected to different stress conditions than the predetermined stress conditions applied to the reference pixels 130. FIG. 3 is a graph showing different stress conditions over time for an active pixel 104 that shows luminance levels emitted over time. During a first time period, the luminance of the active pixel is represented by trace 302, which shows that the luminance is between 300 and 500 nits (cd/cm$^2$). The stress condition applied to the active pixel during the trace 302 is therefore relatively high. In a second time period, the luminance of the active pixel is represented by a trace 304, which shows that the luminance is between 300 and 100 nits. The stress condition during the trace 304 is therefore lower than that of the first time period and the age effects of the pixel during this time differ from the higher stress condition. In a third time period, the luminance of the active pixel is represented by a trace 306, which shows that the luminance is between 100 and 0 nits. The stress condition during this period is lower than that of the second period. In a fourth time period, the luminance of the active pixel is represented by a trace 308 showing a return to a higher stress condition based on a higher luminance between 400 and 500 nits.

The limited number of reference pixels 130 and corresponding limited numbers of stress conditions may require the use of averaging or continuous (moving) averaging for the specific stress condition of each active pixel 104. The specific stress conditions may be mapped for each pixel as a linear combination of characteristic correlation curves from several reference pixels 130. The combinations of two characteristic curves at predetermined stress conditions allow accurate compensation for all stress conditions occurring between such stress conditions. For example, the two reference characterization correlation curves for high and low stress conditions allow a close characterization correlation curve for an active pixel having a stress condition between the two reference curves to be determined. The first and second reference characterization correlation curves stored in the memory 118 are combined by the controller 112 using a weighted moving average algorithm. A stress condition at a certain time St ($t_i$) for an active pixel may be represented by:

$$St(t_i)=(St(t_{i-1})*k_{avg}+L(t_i))/(k_{avg}+1)$$

In this equation, $St(t_{i-1})$ is the stress condition at a previous time, $k_{avg}$ is a moving average constant. $L(t_i)$ is the measured luminance of the active pixel at the certain time, which may be determined by:

$$L(t_i) = L_{peak}\left(\frac{g(t_i)}{g_{peak}}\right)^{\gamma}$$

In this equation, $L_{peak}$ is the highest luminance permitted by the design of the display system 100. The variable, $g(t_i)$ is the grayscale at the time of measurement, $g_{peak}$ is the highest grayscale value of use (e.g., 255) and is a gamma constant. A weighted moving average algorithm using the characterization correlation curves of the predetermined high and low stress conditions may determine the compensation factor, $K_{comp}$, via the following equation:

$$K_{comp}=K_{high}f_{high}(\Delta I)+K_{low}f_{low}(\Delta I)$$

In this equation, $f_{high}$ is the first function corresponding to the characterization correlation curve for a high predetermined stress condition and $f_{low}$ is the second function corresponding to the characterization correlation curve for a low predetermined stress condition. AI is the change in the current in the OLED for a fixed voltage input, which shows the change (electrical degradation) due to aging effects measured at a particular time. It is to be understood that the change in current may be replaced by a change in voltage, ΔV, for a fixed current. $K_{high}$ is the weighted variable assigned to the characterization correlation curve for the high stress condition and $K_{low}$, is the weight assigned to the characterization correlation curve for the low stress condition. The weighted variables $K_{high}$ and $K_{low}$ may be determined from the following equations:

$$K_{high}=St(t_i)/L_{high}$$

$$K_{low}=1-K_{high}$$

Where $L_{high}$ is the luminance that was associated with the high stress condition.

The change in voltage or current in the active pixel at any time during operation represents the electrical characteristic while the change in current as part of the function for the high or low stress condition represents the optical characteristic. In this example, the luminance at the high stress condition, the peak luminance, and the average compensation factor (function of difference between the two characterization correlation curves), $K_{avg}$, are stored in the memory 118 for determining the compensation factors for each of the active pixels. Additional variables are stored in the memory 118 including, but not limited to, the grayscale value for the maximum luminance permitted for the display system 100 (e.g., grayscale value of 255). Additionally, the average compensation factor, $K_{avg}$, may be empirically determined from the data obtained during the application of stress conditions to the reference pixels.

As such, the relationship between the optical degradation and the electrical aging of any pixel 104 in the display system 100 may be tuned to avoid errors associated with divergence in the characterization correlation curves due to different stress conditions. The number of characterization correlation curves stored may also be minimized to a number providing confidence that the averaging technique will be sufficiently accurate for required compensation levels.

The compensation factor, $K_{comp}$ can be used for compensation of the OLED optical efficiency aging for adjusting programming voltages for the active pixel. Another technique for determining the appropriate compensation factor for a stress condition on an active pixel may be termed dynamic moving averaging. The dynamic moving averaging technique involves changing the moving average coefficient, $K_{avg}$, during the lifetime of the display system 100 to compensate between the divergence in two characterization correlation curves at different predetermined stress conditions in order to prevent distortions in the display output. As the OLEDs of the active pixels age, the divergence between two characterization correlation curves at different stress conditions increases. Thus, $K_{avg}$ may be increased during the lifetime of the display system 100 to avoid a sharp transition between the two curves for an active pixel having a stress condition falling between the two predetermined stress conditions. The measured change in current, may be used to adjust the $K_{avg}$ value to improve the performance of the algorithm to determine the compensation factor.

Another technique to improve performance of the compensation process termed event-based moving averaging is to reset the system after each aging step. This technique further improves the extraction of the characterization correlation curves for the OLEDs of each of the active pixels 104. The display system 100 is reset after every aging step (or after a user turns on or off the display system 100). In this example, the compensation factor, $K_{comp}$ is determined by $$K_{comp}=K_{comp_evt}+K_{high}(f_{high}(\Delta I)-f_{high}(\Delta I_{evt}))+K_{low}(f_{low}(\Delta I)-f_{low}(\Delta I_{evt}))$$

In this equation, $K_{comp_evt}$ is the compensation factor calculated at a previous time, and $_{evt}$ is the change in the OLED current during the previous time at a fixed voltage. As with the other compensation determination technique, the change in current may be replaced with the change in an OLED voltage change under a fixed current.

Figure 4:
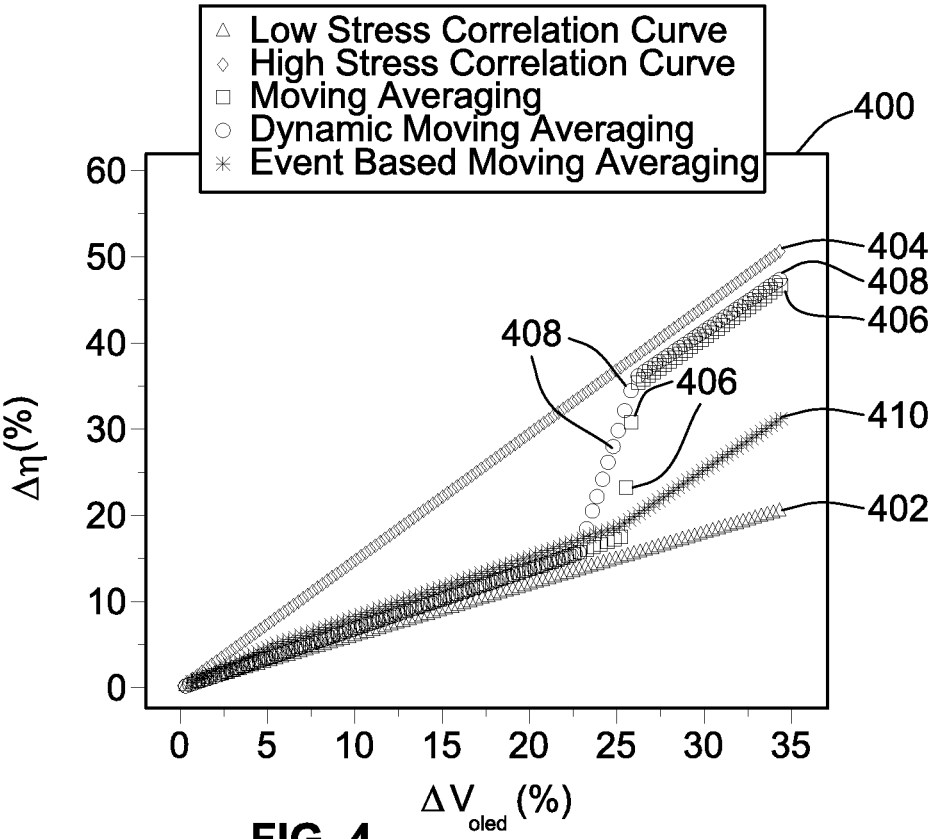
FIG. 4 is a graph of the plots of different characterization correlation curves and the results of techniques of using predetermined stress conditions to determine compensation.

FIG. 4 is a graph 400 showing the different characterization correlation curves based on the different techniques. The graph 400 compares the change in the optical compensation percent and the change in the voltage of the OLED of the active pixel required to produce a given current. As shown in the graph 400, a high stress predetermined characterization correlation curve 402 diverges from a low stress predetermined characterization correlation curve 404 at greater changes in voltage reflecting aging of an active pixel. A set of points 406 represents the correction curve determined by the moving average technique from the predetermined characterization correlation curves 402 and 404 for the current compensation of an active pixel at different changes in voltage. As the change in voltage increases reflecting aging, the transition of the correction curve 406 has a sharp transition between the low characterization correlation curve 404 and the high characterization correlation curve 402. A set of points 408 represents the characterization correlation curve determined by the dynamic moving averaging technique. A set of points 410 represents the compensation factors determined by the event-based moving averaging technique. Based on OLED behavior, one of the above techniques can be used to improve the compensation for OLED efficiency degradation.

As explained above, an electrical characteristic of a first set of sample pixels is measured. For example, the electrical characteristic of each of the first set of sample pixels can be measured by a thin film transistor (TFT) connected to each pixel. Alternatively, for example, an optical characteristic (e.g., luminance) can be measured by a photo sensor provided to each of the first set of sample pixels. The amount of change required in the brightness of each pixel can be extracted from the shift in voltage of one or more of the pixels. This may be implemented by a series of calculations to determine the correlation between shifts in the voltage or current supplied to a pixel and/or the brightness of the light-emitting material in that pixel.

The above described methods of extracting characteristic correlation curves for compensating aging of the pixels in the array may be performed by a processing device such as the controller 112 in FIG. 1 or another such device, which may be conveniently implemented using one or more general purpose computer systems, microprocessors, digital signal processors, micro-controllers, application specific integrated circuits (ASIC), programmable logic devices (PLD), field programmable logic devices (FPLD), field programmable gate arrays (FPGA) and the like, programmed according to the teachings as described and illustrated herein, as will be appreciated by those skilled in the computer, software, and networking arts.

In addition, two or more computing systems or devices may be substituted for any one of the controllers described herein. Accordingly, principles and advantages of distributed processing, such as redundancy, replication, and the like, also can be implemented, as desired, to increase the robustness and performance of controllers described herein.

The operation of the example characteristic correlation curves for compensating aging methods may be performed by machine readable instructions. In these examples, the machine readable instructions comprise an algorithm for execution by: (a) a processor, (b) a controller, and/or (c) one or more other suitable processing device(s). The algorithm may be embodied in software stored on tangible media such as, for example, a flash memory, a CD-ROM, a floppy disk, a hard drive, a digital video (versatile) disk (DVD), or other memory devices, but persons of ordinary skill in the art will readily appreciate that the entire algorithm and/or parts thereof could alternatively be executed by a device other than a processor and/or embodied in firmware or dedicated hardware in a well-known manner (e.g., it may be implemented by an application specific integrated circuit (ASIC), a programmable logic device (PLD), a field programmable logic device (FPLD), a field programmable gate array (FPGA), discrete logic, etc.). For example, any or all of the components of the characteristic correlation curves for compensating aging methods could be implemented by software, hardware, and/or firmware. Also, some or all of the machine readable instructions represented may be implemented manually.

Figure 5:
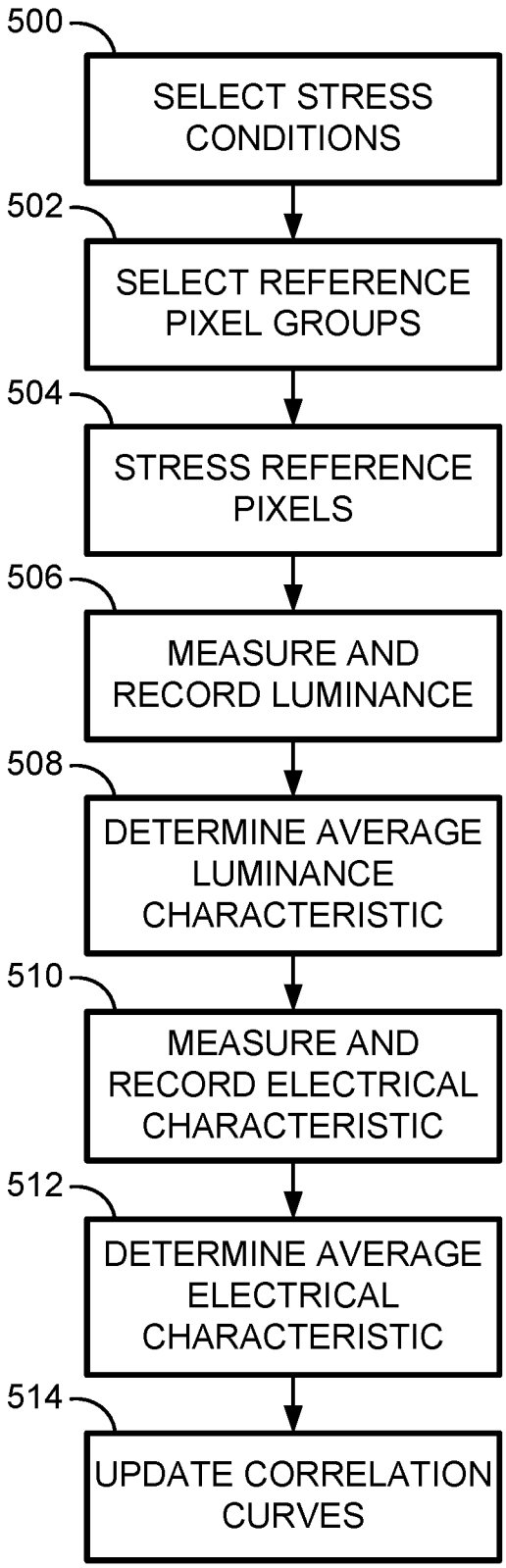
FIG. 5 is a flow diagram of the process of determining and updating characterization correlation curves based on groups of reference pixels under predetermined stress conditions.

FIG. 5 is a flow diagram of a process to determine and update the characterization correlation curves for a display system such as the display system 100 in FIG. 1. A selection of stress conditions is made to provide sufficient baselines for correlating the range of stress conditions for the active pixels (500). A group of reference pixels is then selected for each of the stress conditions (502). The reference pixels for each of the groups corresponding to each of the stress conditions are then stressed at the corresponding stress condition and base line optical and electrical characteristics are stored (504). At periodic intervals the luminance levels are measured and recorded for each pixel in each of the groups (506). The luminance characteristic is then determined by averaging the measured luminance for each pixel in the group of the pixels for each of the stress conditions (508). The electrical characteristics for each of the pixels in each of the groups are determined (510). The average of each pixel in the group is determined to determine the average electrical characteristic (512). The average luminance characteristic and the average electrical characteristic for each group are then used to update the characterization correlation curve for the corresponding predetermined stress condition (514). Once the correlation curves are determined and updated, the controller may use the updated characterization correlation curves to compensate for aging effects for active pixels subjected to different stress conditions.

Figure 6:
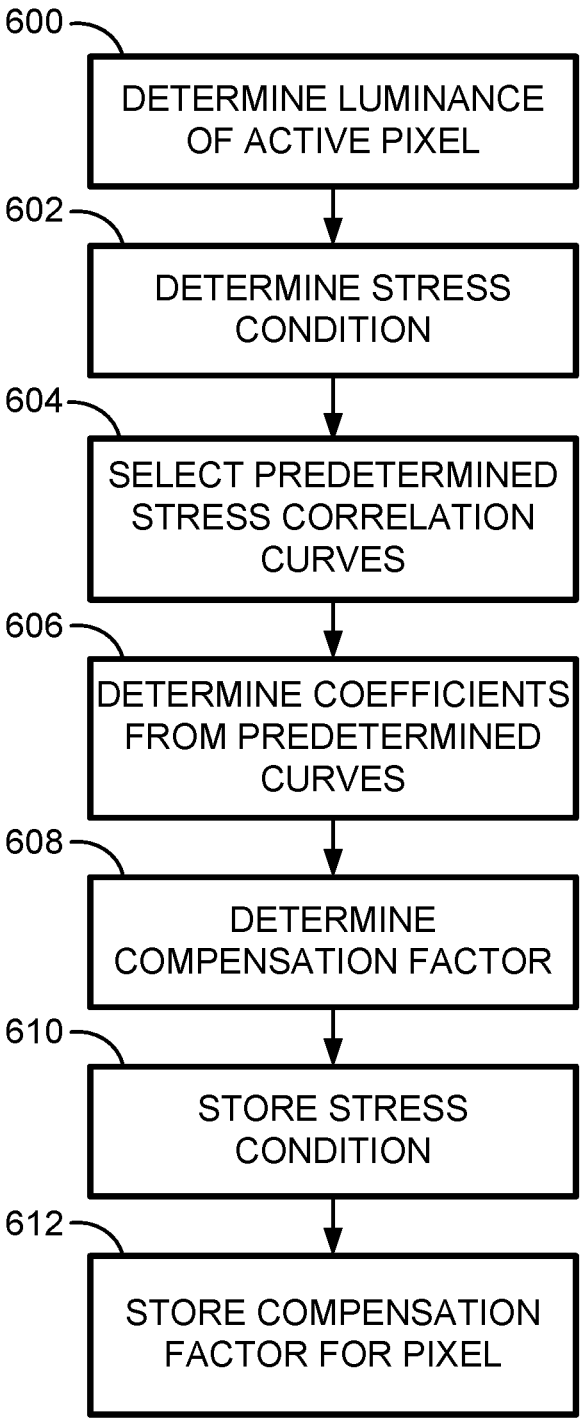
FIG. 6 is a flow diagram of the process of compensating the programming voltages of active pixels on a display using predetermined characterization correlation curves.

Referring to FIG. 6, a flowchart is illustrated for a process of using appropriate predetermined characterization correlation curves for a display system 100 as obtained in the process in FIG. 5 to determine the compensation factor for an active pixel at a given time. The luminance emitted by the active pixel is determined based on the highest luminance and the programming voltage (600). A stress condition is measured for a particular active pixel based on the previous stress condition, determined luminance, and the average compensation factor (602). The appropriate predetermined stress characterization correlation curves are read from memory (604). In this example, the two characterization correlation curves correspond to predetermined stress conditions that the measured stress condition of the active pixel falls between. The controller 112 then determines the coefficients from each of the predetermined stress conditions by using the measured current or voltage change from the active pixel (606). The controller then determines a modified coefficient to calculate a compensation voltage to add to the programming voltage to the active pixels (608). The determined stress condition is stored in the memory (610). The controller 112 then stores the new compensation factor, which may then be applied to modify the programming voltages to the active pixel during each frame period after the measurements of the reference pixels 130 (612).

Figure 7:
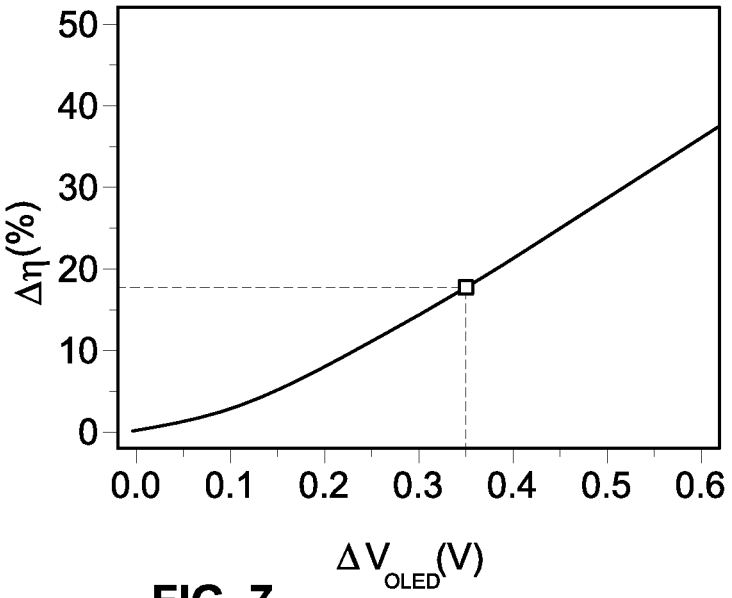
FIG. 7 is an interdependency curve of OLED efficiency degradation versus changes in OLED voltage.

OLED efficiency degradation can be calculated based on an interdependency curve based on OLED electrical changes versus efficiency degradation, such as the interdependency curve in FIG. 7. Here, the change in the OLED electrical parameter is detected, and that value is used to extract the efficiency degradation from the curve. The pixel current can then be adjusted accordingly to compensate for the degradation. The main challenge is that the interdependency curve is a function of stress conditions. Therefore, to achieve more accurate compensation, one needs to consider the effect of different stress conditions. One method is to use the stress condition of each pixel (or a group of pixels) to select from among different interdependency curves, to extract the proper efficiency lost for each specific case. Several methods of determining the stress condition will now be described.

Figure 8:
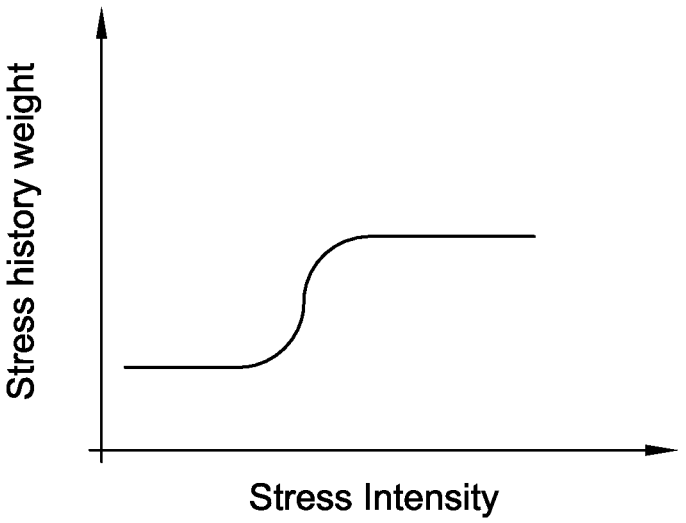
FIG. 8 is a graph of OLED stress history versus stress intensity.

First, one can create a stress history for each pixel (or group of pixels). The stress history can be simply a moving average of the stress conditions. To improve the calculation accuracy, a weighted stress history can be used. Here, the effect of each stress can have a different weight based on stress intensity or period, as in the example depicted in FIG. 8. For example, the effect of low intensity stress is less on selecting the OLED interdependency curve. Therefore, a curve that has lower weight for small intensity can be used, such as the curve in FIG. 8. Sub-sampling can also be used to calculate the stress history, to reduce the memory transfer activities. In one case, one can assume the stress history is low frequency in time. In this case, there is no need to sample the pixel conditions for every frame. The sampling rate can be modified for different applications based on content frame rate. Here, during every frame only a few pixels can be selected to obtain an updated stress history.

In another case, one can assume the stress history is low frequency in space. In this case, there is no need to sample all the pixels. Here, a sub-set of pixels are used to calculate the stress history, and then an interpolation technique can be used to calculate the stress history for all the pixels.

In another case, one can combine both low sampling rates in time and space.

Figure 9A:
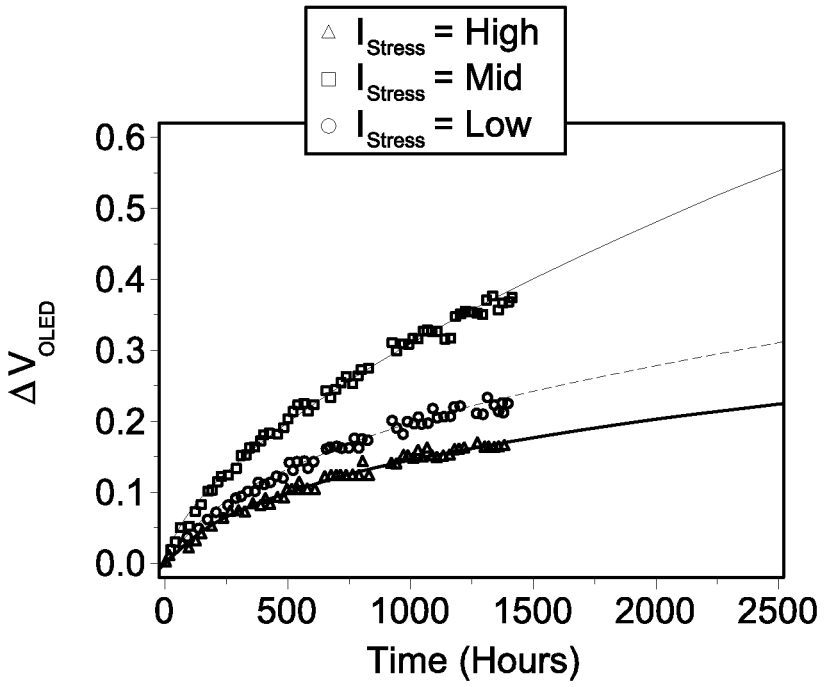
FIG. 9A is a graph of change in OLED voltage versus time for different stress conditions.
Figure 9B:
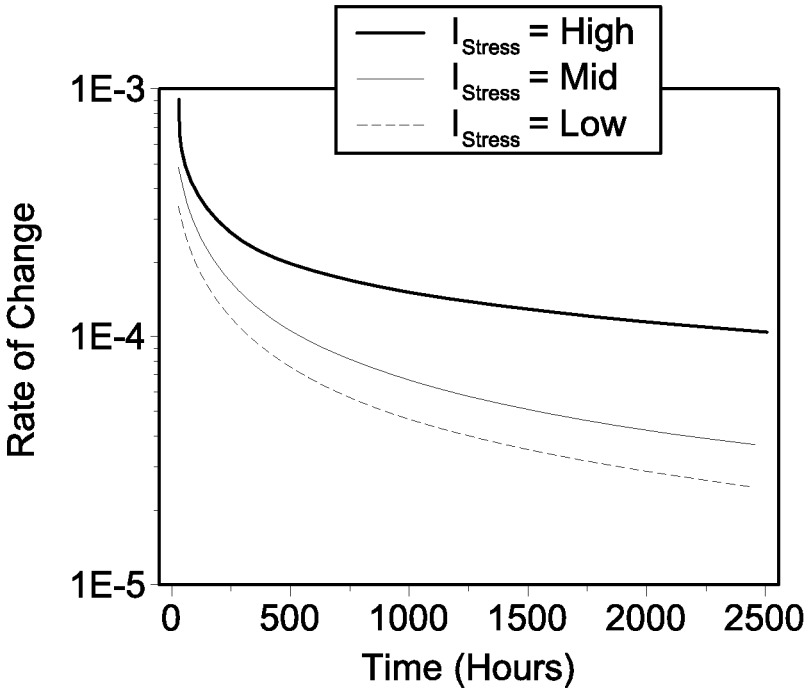
FIG. 9B is a graph of rate of change of OLED voltage versus time for different stress conditions.

In some cases, including the memory and calculation block required for stress history may not be possible. Here, the rate of change in the OLED electrical parameter can be used to extract the stress conditions, as depicted in FIGS. 9A and 9B. FIG. 9A illustrates the change of $\Delta V_{OLED}$ with time, for low, medium and high stress conditions, and FIG. 9B illustrates the rate of change versus time for the same three stress conditions.

Figure 10:
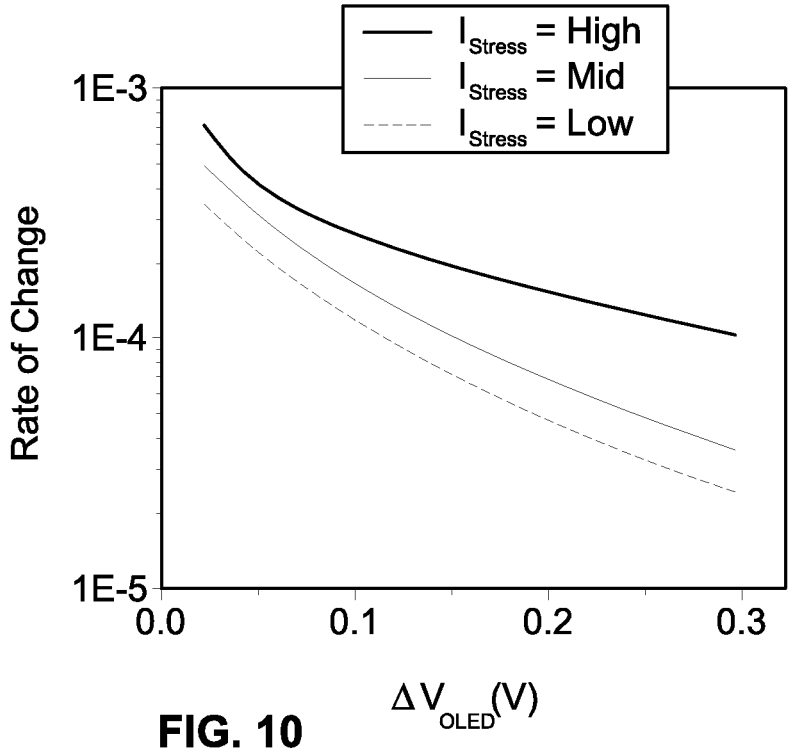
FIG. 10 is a graph of rate of change of OLED voltage versus change in OLED voltage, for different stress conditions.

As illustrated in FIG. 10, the rate of change in the electrical parameter can be used as an indicator of stress conditions. For example, the rate of change in the electrical parameter based on the change in the electrical parameter may be modeled or experimentally extracted for different stress conditions, as depicted in FIG. 10. The rate of change may also be used to extract the stress condition based on comparing the measured change and rate of change in the electrical parameter. Here, the function developed for change and rate of change of the electrical parameter is used. Alternatively, the stress condition, interdependency curves, and measured changed parameter may be used.

Figure 11:
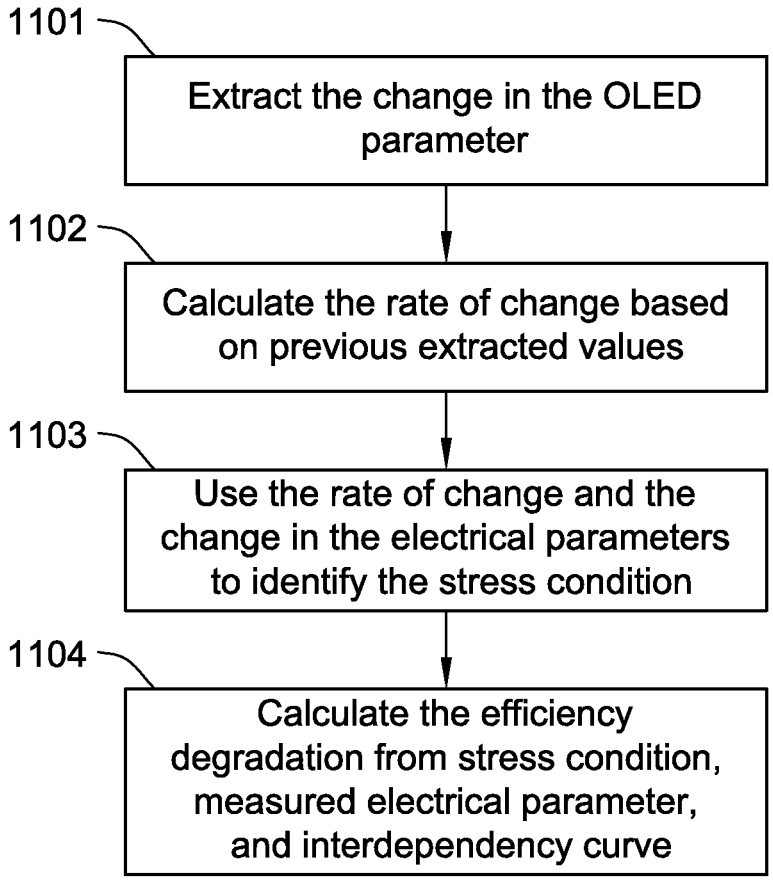
FIG. 11 is a flow chart of a procedure for extracting OLED efficiency degradation from changes in an OLED parameter such as OLED voltage.

FIG. 11 is a flow chart of a procedure for compensating the OLED efficiency degradation based on measuring the change and rate of change in the electrical parameter of the OLED. In this procedure, the change in the OLED parameter (e.g., OLED voltage) is extracted in step 1101, and then the rate of change in the OLED parameter, based on previously extracted values, is calculated in step 1102. Step 1103 then uses the rate of change and the change in the parameter to identify the stress condition. Finally, step 1104 calculates the efficiency degradation from the stress condition, the measured parameter, and interdependency curves.

Figure 12:
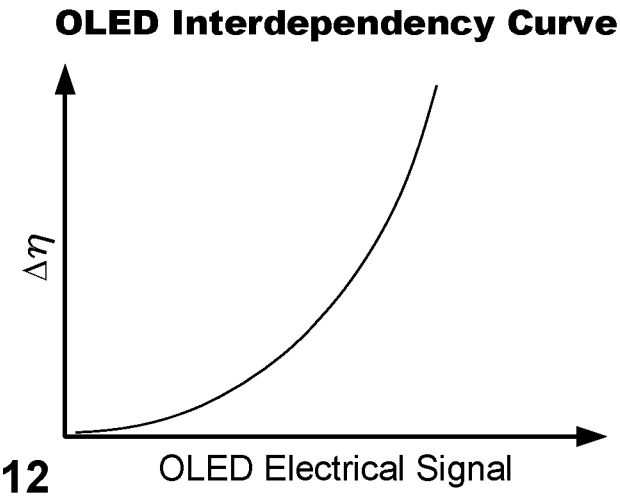
FIG. 12 is an OLED interdependency curve relating an OLED electrical signal and efficiency degradation.

One can compensate for OLED efficiency degradation using interdependency curves relating OLED electrical change (current or voltage) and efficiency degradation, as depicted in FIG. 12. Due to process variations, the interdependency curve may vary. In one example, a test OLED can be used in each display and the curve extracted for each display after fabrication or during the display operation. In the case of smaller displays, the test OLED devices can be put on the substrates and used to extract the curves after fabrication.

Figure 13:
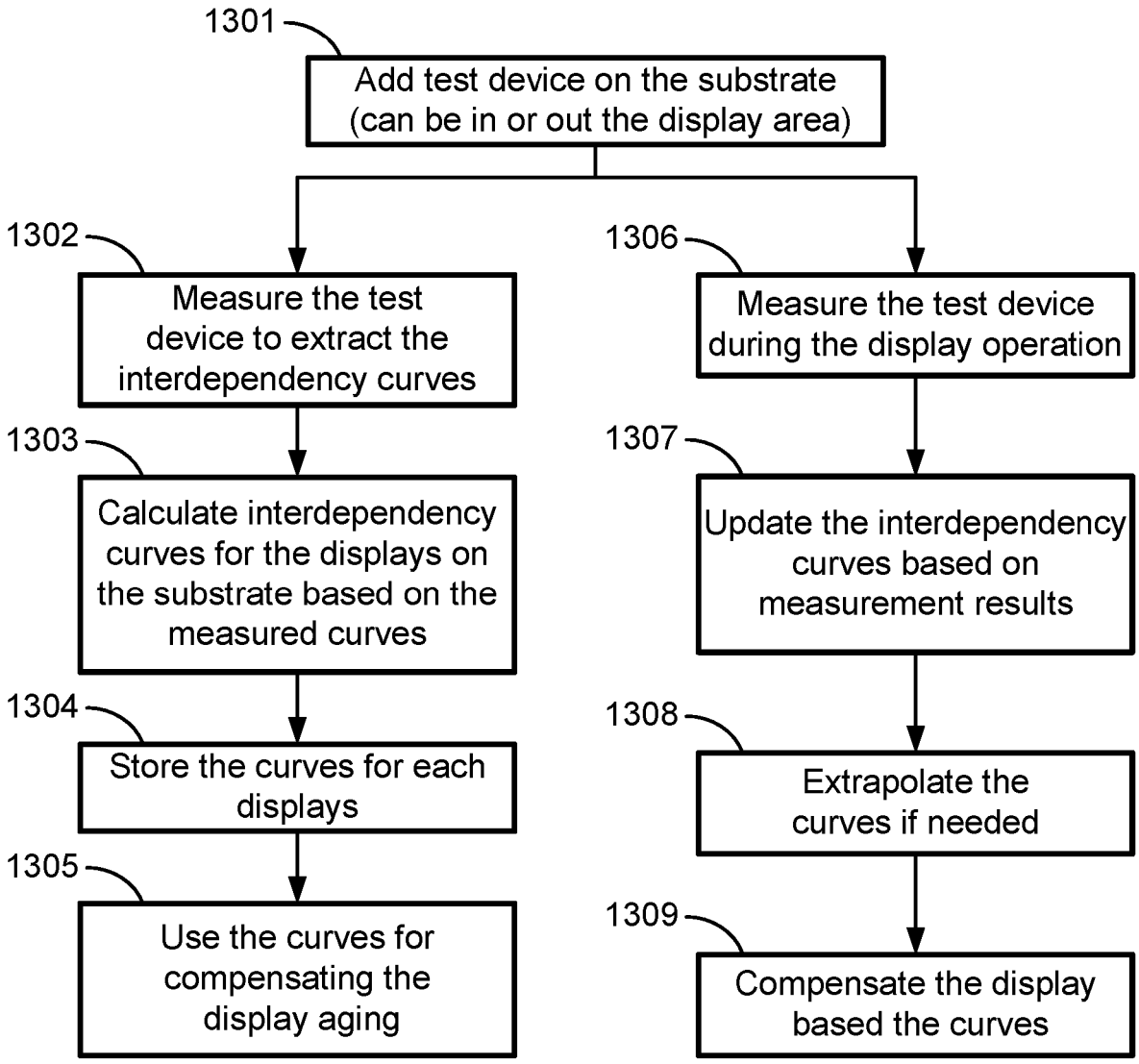
FIG. 13 is a flow chart of a procedure for extracting interdependency curves from test devices.

FIG. 13 is a flow chart of a process for extracting the interdependency curves from the test devices, either off line or during the display operation, or a combination of both. In this case, the curves extracted in the factory are stored for aging compensation. During the display operation, the curve can be updated with additional data based on measurement results of the test device in the display. However, since extraction may take time, a set of curves may measured in advance and put in the library. Here, the test devices are aged at predetermined aging levels (generally higher than normal) to extract some aging behavior in a short time period (and/or their current-voltage-luminance, IVL, is measured). After that, the extracted aging behavior is used to find a proper curve, having a similar or close aging behavior, from the library of curves.

In FIG. 13, the first step 1301 adds the test device on the substrate, in or out of the display area. Then step 1302 measures the test device to extract the interdependency curves. Step 1303 calculates the interdependency curves for the displays on the substrate, based on the measured curves. The curves are stored for each display in step 1304, and then used for compensating the display aging in step 1305. Alternatively, the test devices can be measured during the display operation at step 1306. Step 1307 then updates the interdependence curves based on the measured results. Step 1308 extrapolates the curves if needed, and step 1309 compensates the display based on the curves.

The following are some examples of procedures for finding a proper curve from a library:

(1) Choose the one with closest aging behavior (and/or IVL characteristic).

(2) Use the samples in the library with the closer behavior to the test sample and create a curve for the display. Here, weighted averaging can be used in which the weight of each curve is determined based on the error between their aging behaviors.

(3) If the error between the closet set of curves in the library and the test device is higher than a predetermined threshold, the test device can be used to create new curves and add them to the library.

Figure 14:
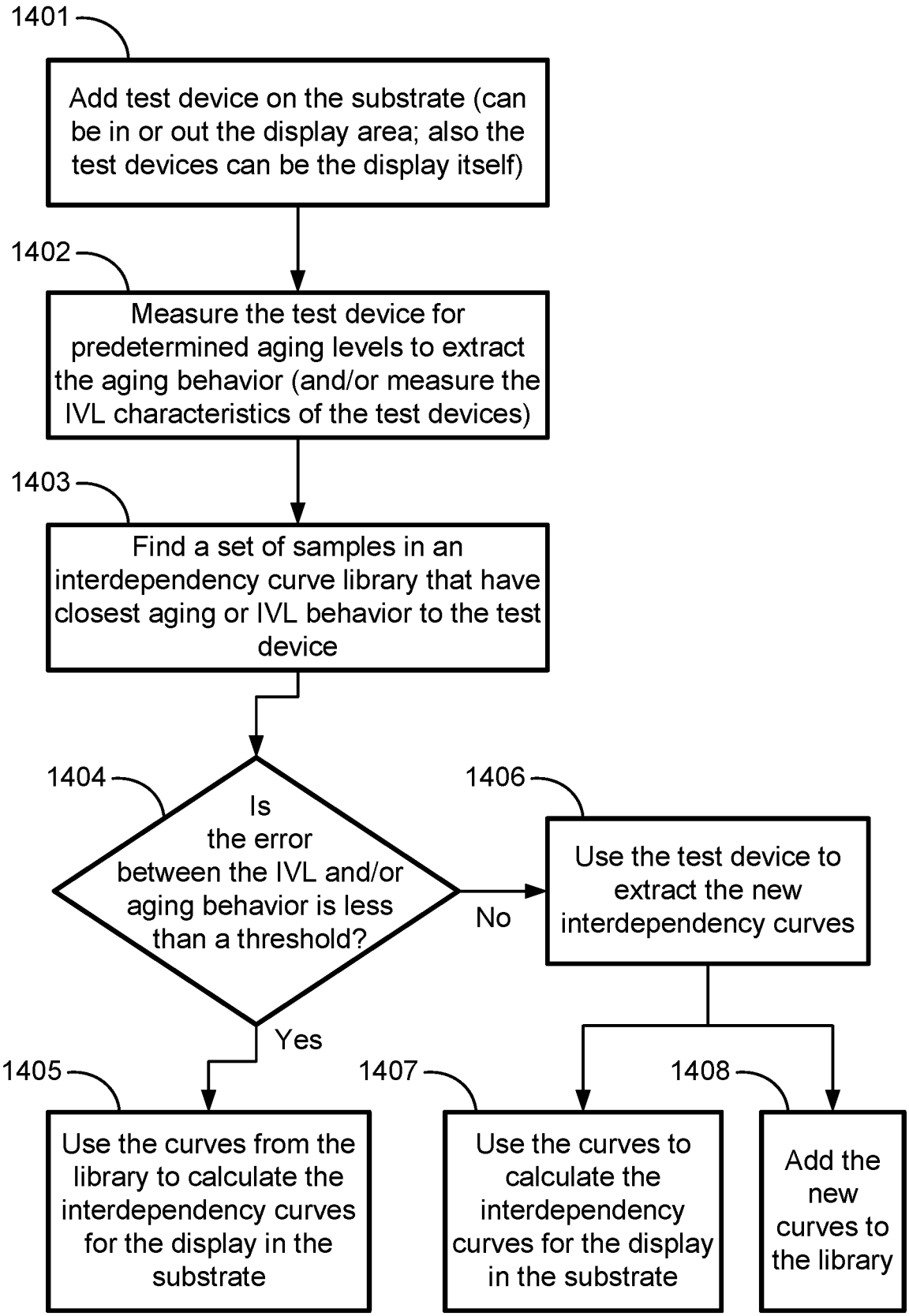
FIG. 14 is a flow chart of a procedure for calculating interdependency curves from a libray.

FIG. 14 is a flow chart of a procedure for addressing the process variation between substrates or within a substrate. The first step 1401 adds a test device on the substrate, either in or out of the display area, or the test device can be the display itself. Step 1402 then measures the test device for predetermined aging levels to extract the aging behavior and/or measures the IVL characteristics of the test devices. Step 1403 finds a set of samples in an interdependency curve library that have the closest aging or IVL behavior to the test device. Then step 1404 determines whether the error between the IVL and/or aging behavior is less than a threshold. If the answer is affirmative, step 1405 uses the curves from the library to calculate the interdependency curves for the display in the substrate. If the answer at step 1404 is negative, step 1406 uses the test device to extract the new interdependency curves. Then the curves are used to calculate the interdependency curves for the display in the substrate in step 1407, and step 1408 adds the new curves to the library.

Semiconductor devices (e.g., OLEDs) may age differently under different ambient conditions (e.g., temperature, illumination, etc.) in addition to stress conditions. Moreover, some rare stress conditions may push the devices into aging conditions that are different from normal conditions. For example, an extremely high stress condition may damage the device physically (e.g., affecting contacts or other layers). In this case, identifying a compensation curve may require additional information, which can be obtained from the other devices in the pixel (e.g., transistors or sensors), from rates of change in the device characteristics (e.g., threshold voltage shift or mobility change), or by using the change in a multiple-device parameter to identify the stress conditions. In the case of using other devices, the rate of change in the other device parameters and/or the rate (or the absolute value) of change in the other-device parameter compared with the rate (or the absolute value) of change in the device parameter can be used to identify the aging condition. For example, at higher temperature, the TFT and the OLED become faster and so the rate of change can be an indicator of the temperature variation at which a TFT or an OLED is aged.

Figure 15B:
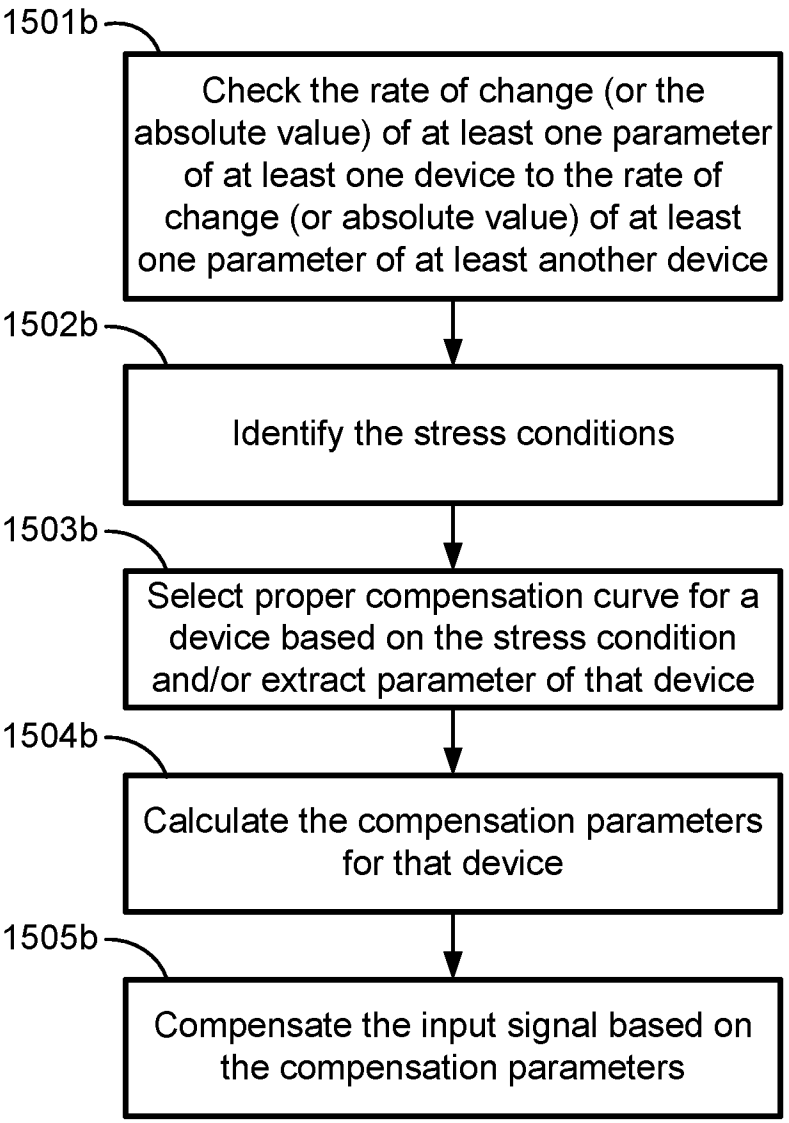
FIG. 15B is a flow chart of a procedure for identifying the stress condition of a device based on the rate of change or absolute value of a parameter of the device and the rate of change or absolute value of a parameter of another device.
Figure 15A:
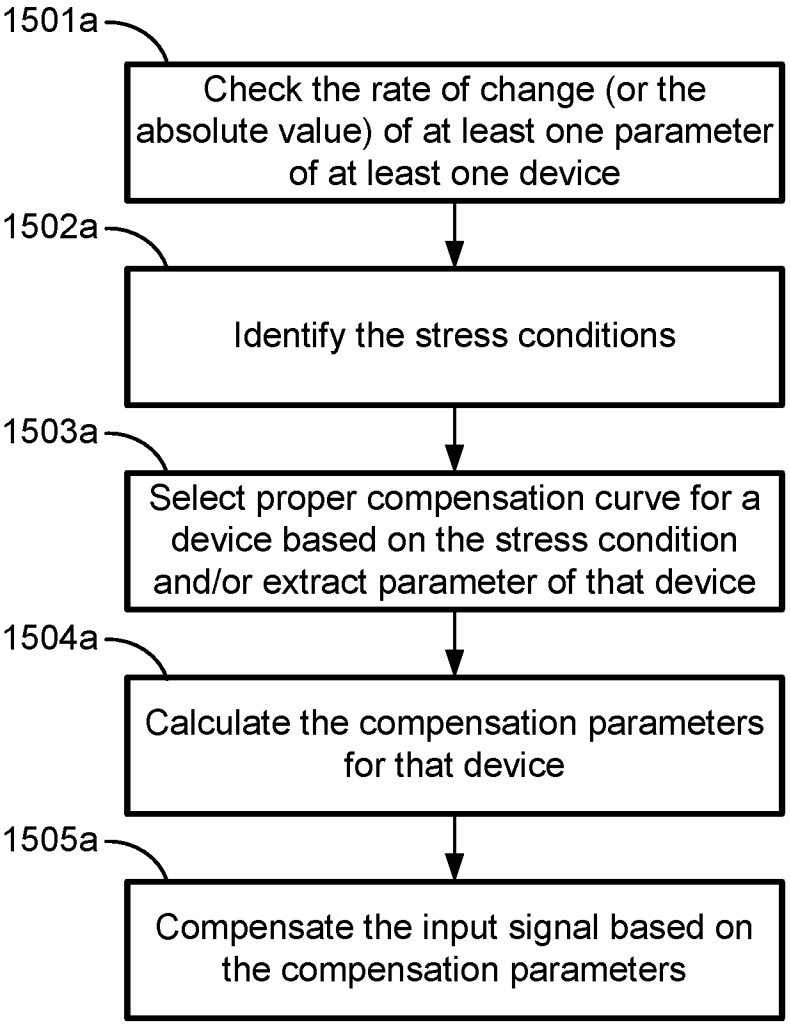
FIG. 15A is a flow chart of a procedure for identifying the stress condition of a device based on the rate of change or absolute value of a parameter of the device.

FIGS. 15A and 15B are flow charts that illustrate procedures for identifying the stress conditions for a device based on either the rate of change or absolute value of at least one parameter of at least one device, or on a comparison of the rate of change or absolute value of at least one parameter of at least one device to the rate of change or absolute value of at least one parameter of at least one other device. The identified stress conditions are used to select a proper compensation curve based on the identified stress conditions and/or extract a parameter of the device. The selected compensation curve is used to calculate compensation parameters for the device, and the input signal is compensated based on the calculated compensation parameters.

In FIG. 15A, the first step 1501*a* checks the rate of change or absolute value of at least one parameter of at least one device, such as an OLED, and then step 1502*a* identifies the stress conditions from that rate of change or absolute value. Step 1503*a* then selects the proper compensation curve for a device based on an identified stress condition and/or extracts a parameter of that device. The selected compensation curve is used at step 1504*a* to calculate compensation parameters for that device, and then step 1505*a* compensates the input signal based on the calculated compensation parameters.

In FIG. 15B, the first step 1501*b* compares the rate of change or absolute value of at least one parameter of at least one device, such as an OLED, to the rate of change or absolute value of at least one parameter of at least one other device. Step 1502*b* then identifies the stress conditions from that comparison, and step 1503*b* selects the proper compensation curve for a device based on an identified stress condition and/or extracts a parameter of that device. The selected compensation curve is used at step 1504*b* to calculate compensation parameters for that device, and then step 1505*b* compensates the input signal based on the calculated compensation parameters.

Figure 16:
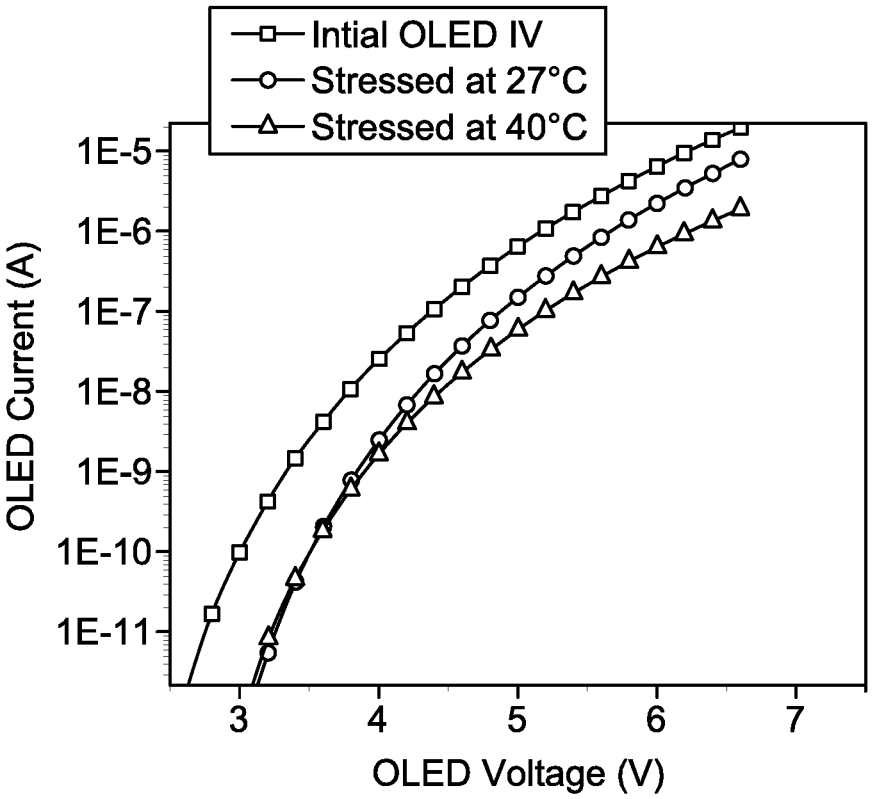
FIG. 16 is an example of the IV characteristic of an OLED subjected to three different stress conditions.

In another embodiment, one can look at the rates of change in different parameters in one device to identify the stress condition. For example, in the case of an OLED, the shift in voltage (or current) at different current levels (or voltage levels) can identify the stress conditions. FIG. 16 is an example of the IV characteristics of an OLED for three different conditions, namely, initial condition, stressed at 27° C., and stressed at 40° C. It can be seen that the characteristics change significantly as the stress conditions change.

Figure 17:
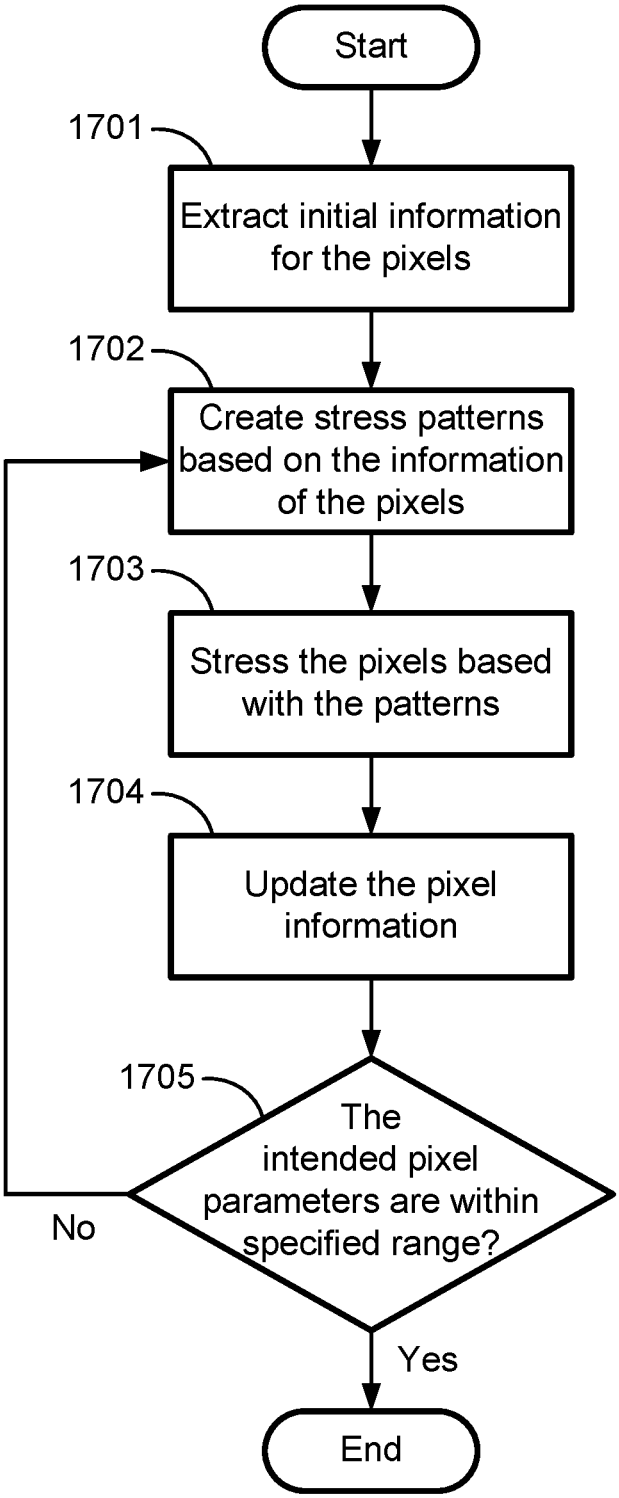
FIG. 17 is a flow chart of a procedure for achieving initial equalization of pixels in an emissive display.
Figure 18:
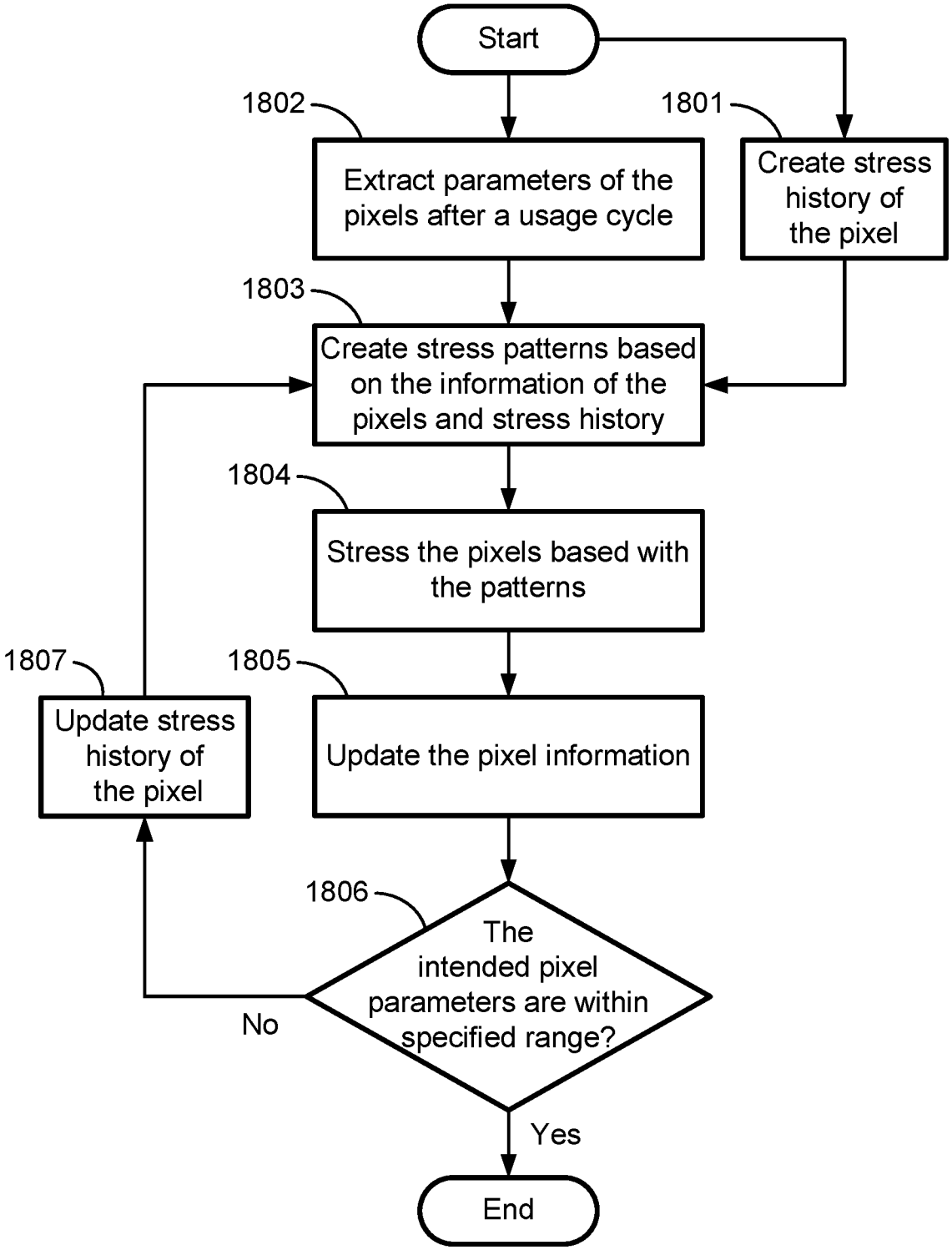
FIG. 18 is a flow chart of a procedure for achieving equalization of pixels in an emissive display after a usage cycle.

FIGS. 17 and 18 are flow charts of procedures for equalizing pixels in an emissive display panel having an array of pixels that include semiconductor devices that age under different ambient and stress conditions. FIG. 17 illustrates a procedure for achieving initial equalization of the pixels, and FIG. 18 illustrates a procedure for equalizing the pixels after a usage cycle.

In the procedure illustrated in FIG. 17, at least one pixel parameter (pixel information) is extracted from the emissive display panel at step 1701. These parameters are used to create stress patterns for the panel at step 1702. The stress patterns are applied to the panel at step 1703, and the pixel parameters are monitored and updated at step 1704 by extracting the pixel parameter from the stressed pixels. Step 1705 determines whether the pixel parameters extracted from the stressed pixels is within a preselected range, and if the answer is negative, steps 1702-1705 are repeated. This process continues until step 1705 produces a positive answer, which means that the pixel parameters extracted from the stressed pixels are within the preselected range, and thus the pixels are returned to normal operation.

The stress pattern can include duration and stress level. In one embodiment of the invention, the pixel parameters are monitored in-line during the stress to assure the parameters of the pixels do not pass the specified range. In another embodiment of the invention, the parameters of selected pixels or some reference pixels are monitored in-line during stress. In another embodiment of the invention, the pixels are stressed for a period of time and then the pixel parameters are extracted. After that the pixel parameters are updated and the stress pattern and timing can be updated with new data including new pixel parameters and the rate of change. For example, if the rate of change is fast, the stress intervals can be smaller to avoid passing the specified ranges for pixel parameters.

The setting for the parameters of the pixels can be variation between the parameters across the panel. In another embodiment it can be specific value.

In one example, the pixel information (or parameter) can be the threshold voltage of the drive TFT. Here, the stress condition of each pixel is defined based on its threshold voltage. In another example, the pixel parameter can be the voltage of the emissive devices (or the brightness uniformity).

The pixel information can be extracted through different means. One method can be through a power supply. In another case, the pixel parameters can be extracted through a monitor line.

In FIG. 18, the pixel parameters are extracted after a usage cycle. For example, the extraction can be triggered by a user, by a timer, or by a specific operating condition (e.g., being in charging mode). The stress history of the pixels is created during the usage cycle at step 1801, and the pixel parameters are extracted after the usage cycle at step 1801. The stress history can include the stress level during the operation and the stress time. In another embodiment, the stress history can be the average stress condition of the pixel during the usage cycle.

Based on the extracted pixel parameters and the stress history, stress patterns are generated at step 1803. Then the pixels are stressed at step 1804, in accordance with the generated stress pattern. The parameters of the stressed pixels are monitored and updated at step 1805 by extracting the pixel parameter from the stressed pixels. Step 1806 determines whether the pixel parameters extracted from the stressed pixels is within a preselected range, and if the answer is negative, step 1807 updates the stress history of the pixels, and then steps 1803-1806 are repeated. This process continues until step 1806 produces a positive answer, which means that the pixel parameters extracted from the stressed pixels are within the preselected range, and thus the pixels are returned to normal operation.

In one example, the pixels are assigned to different categories based on the stress history, and then the pixels are stressed with all the other categories that they are not assigned to. At the same time, the pixel parameters are monitored similar to the previous case to assure they do not pass the specified ranges.

In another example, the stress history has no timing information, and the change in pixel parameters can be used to identify the stress level and timing. For example, in one case, shift in the electrical characteristics of the emissive device can be used to extract the stress condition of each pixel for the stress pattern.

In yet another embodiment, the interdependency curves between pixel parameters and its optical performance can be used to extract the stress condition for each pixel. In the case of electrical characteristics of the emissive device, the interdependency curves can be used to find the worst case of efficiency degradation. Then, the delta efficiency between each pixel and the worst case can be determined. After that, the corresponding change in electrical characteristics of the emissive device of each pixel can be calculated to minimize the difference in efficiency between the pixel and the worst case. Then the pixels are stressed, and their pixel parameters (e.g., electrical characteristics of the emissive device) are monitored to reach the calculated shift. Similar operations can be used for other pixel parameters as well.

Efficiency degradation of electro-luminance devices can affect the performance of devices such as displays. This degradation is due to stress and other conditions such as temperature. Interdependency curves are the relation between an OLED's characteristics and its luminance degradation, therefore, interdependency curves are what connect the measurement data (electrical characteristics) to the characteristic (luminance degradation) that needs to be compensated for. For example, in the case of an emissive device, the electrical characteristics of the device can be measured easily. In one example, the OLED characteristic can be OLED voltage shift for a given current as a result of stress. However, the final characteristic that is required to be compensated for are its optical characteristics. In this case, the change in electrical characteristics due to aging (or other conditions) is measured and based on the interdependency curve one can determine how much the optical performance of the device is affected.

A correction algorithm fixes the drive circuit issues by extracting parameters related to the driver circuit and also fixes the optoelectronic device issues such as burn-in by extracting parameters from the device (or other related parameters) and with use of the interdependency curves. Interdependency curves thus show the relation between the extracted parameters (or stress history) for the optoelectronic device and its optical performance degradation.

One method of calculation of the correction factor involves extracting the relationship of the optical degradation and the given value of extracted parameter(s) as a function of stress level. The stress history of a pixel (or a group of pixels) is calculated, and based on the stress level, one or more interdependency curves are selected from different interdependency curves representing different stress levels. From the selected curves and the extracted parameters a correction factor is calculated as a function of the stress level. One simple function can be a linear approximation.

Using interdependency curves to solve the aging issues in optoelectronic devices can eliminate the need for optical sensors. However, some devices may experience different aging behavior as a function of temperature.

Figure 19:
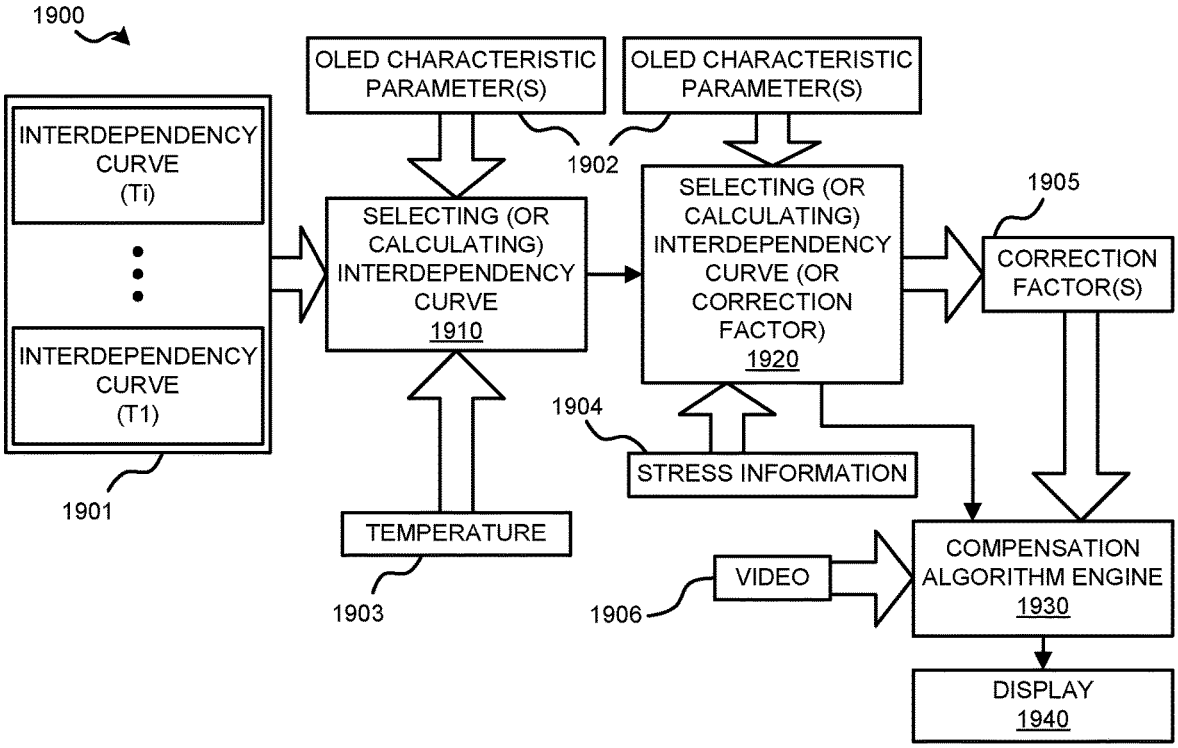
FIG. 19 is a flow chart of a procedure for incorporating temperature as an operating condition associated with the interdependency curves.
Figure 20:
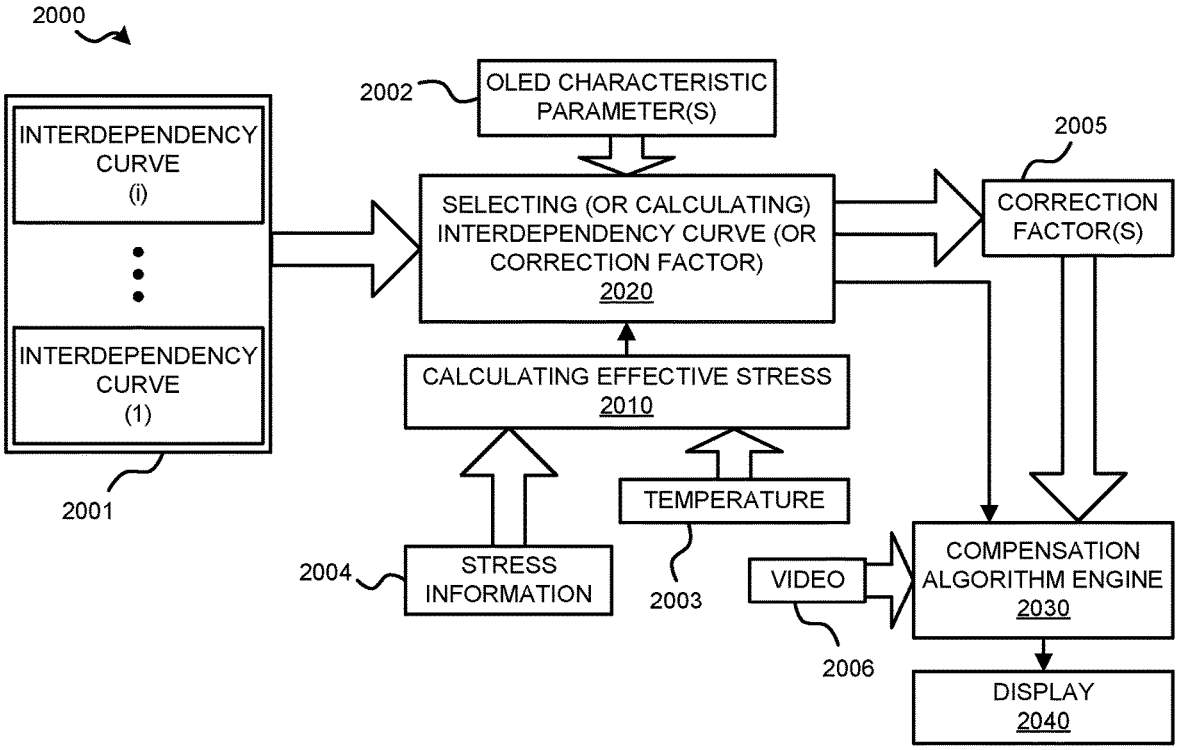
FIG. 20 is a flow chart of a procedure for incorporating temperature as a factor in an effective stress operating condition associated with the interdependency curves.

Referring now to FIG. 19 and FIG. 20, methods of determining correction factors for display compensation taking into account temperature will now be described.

In some optoelectronic devices, the temperature may affect the interdependency curves or as described below, an effective stress. As a result, the system needs to accommodate for the temperature effect as well as the stress levels as described hereinabove. Both the stress levels and the temperature are operating conditions which affect the interdependency curve. To accommodate for the temperature effect as well, the temperature profile of the panel is either measured or estimated and taken into account in the compensation of the display.

In one embodiment depicted in FIG. 20, a method of display compensation which takes into account temperature to extract correction factors from stored interdependency curves, will now be described. A number of interdependency curves based on different temperatures are stored 1901. For example, a number of curves stored for various stress levels, and for various temperatures T1, . . . Ti. After the temperature information 1903 for a pixel (or a group of pixels) is determined through some measurement or estimation, a set of interdependency curves are selected based on the temperature history for the pixel 1910. For example a number of various curves of various stress conditions which also are within some temperature threshold of the pixel temperature or temperature history are selected, or for each stress condition, interdependency curves corresponding to the closest higher temperature and closest lower temperature are selected for interpolation. In this embodiment the temperature of a pixel is periodically measured or estimated and stored as a temperature history of the pixel. As an alternative to selecting interdependency curves, a new interdependency curve is extracted or calculated for the pixel temperature based on a number of interdependency curves 1910, in which case the OLED characteristic parameter is used 1902 to reduce calculations as described below. For example, given a set of interdependency curves for N stress conditions, and for each stress condition M temperatures, when analyzing temperature first, for every stress condition, interpolation curves of the closest higher and lower temperatures are utilized to interpolate curves corresponding to that temperature for each stress condition. To reduce calculation and storage requirements the OLED characteristic of interest (the measure of OLED voltage shift for example) may be used to extract or generate only the points of interest on the new interpolated interdependency curves.

Next, from the selected set of the interdependency curves (or the calculated new interdependency curves or the points of interest) and stress information 1904 (and with use of the OLED characteristic parameter(s) 1902 if not used already to restrict calculation to points of interest) one or more pixel correction factors 1905 are calculated 1920. The one or more correction factors 1905 are used in the correction algorithm 1930 to fix for optical degradation of the optoelectronic device as described hereinabove, so that for example a video signal 1906 is displayed on the display 1940 accurately.

It is to be understood, that since the interdependency curves are stored for various stress conditions and various temperatures, the order of selection and/or calculation based on temperature and stress history 1910 1920 may be changed. For example, as an alternative to the above, given a set of interdependency curves for N stress conditions, and for each stress condition M temperatures, when analyzing stress conditions first, for every temperature within a threshold, interpolation curves of the closest higher and lower stress conditions are utilized to interpolate a curves corresponding the stress condition of the pixel for each close temperature condition. To reduce calculation and storage requirements the OLED characteristic of interest (the measure of OLED voltage shift for example) may be used to extract or generate only the points of interest on the new interdependency curves. Furthermore, a single selection and/or calculation taking into account both temperature and stress history may be utilized to generate appropriate at least one correction factors 1905. In such an algorithm, for example, the interdependency curves for various temperature and stress conditions could be interpolated in terms of both the temperature and stress information of the pixel to extract the correction factor corresponding to the OLED characteristic parameter 1902.

In the case of calculating a new interdependency curve for a given temperature based on a few of the stored interdependency curves 1901, the optoelectronic device characteristic parameters may be used to calculate required output for just those parameters to reduce the calculation load, i.e. generating only points of interest rather than generating entire interdependency curves. In some embodiments utilizing functional curve fitting, in calculating interdependency curves 1910 1920 the between value for each corresponding curve in the sets is extracted for the parameters and then a function is generated for the extracted values and temperature. Here, the value for the given temperature then is calculated based on that function. This is repeated for all the curves in the set.

In another embodiment depicted in FIG. 20, a method of display compensation which takes into account temperature to determine an effective stress, will now be described. As with the embodiment described in association with FIG. 19, a number of interdependency curves based on different stress conditions are stored 2001, e.g., stress conditions 1 . . . I, however in this case the interdependency curves are based on effective stress. In this embodiment, the effect of temperature is considered as a factor in the "effective stress" conditions. The effective stress is calculated 2010 using both the temperature history 2003 and the stress history 2004 of the pixel. Here, after the effective stress condition is calculated, optoelectronic device parameters 2002 are passed to the module to select proper curves for the correction factor calculation 2020. In some embodiments the curves with higher and lower effective stress are selected. Then from the selected set of the interdependency curves, the OLED characteristic parameter 2002, and effective stress information, the pixel correction factor 2005 is calculated 2020 which is used in the correction algorithm 2030 to fix for optical degradation of the optoelectronic device as described hereinabove, so that for example a video signal 2006 is displayed on the display 2040 accurately.

Here, since effective stress takes into account both temperature and standard stress conditions, one can change the order of incorporation of temperature and stress history into the calculations or mix them in one selection function.

For calculating an effective stress condition based on temperature, one can either use models or lookup tables. In some embodiments, the same model or lookup tables utilized to calculate the effective stress 2010 are used to generate and/or index the interdependency curves 2001.

One can mix the two methods described here to improve the correction factor calculation. In addition, if the temperature difference between a pixel (or a group of pixels) temperature and a reference temperature is larger than a threshold, calculation of the correction factor can be performed more often to reduce the effect of higher order conditions. For example, if there is a large temperature change for a short time, its effect might otherwise be ignored if the periodic update time for the OLED correction factor is too long.

Figure 21:
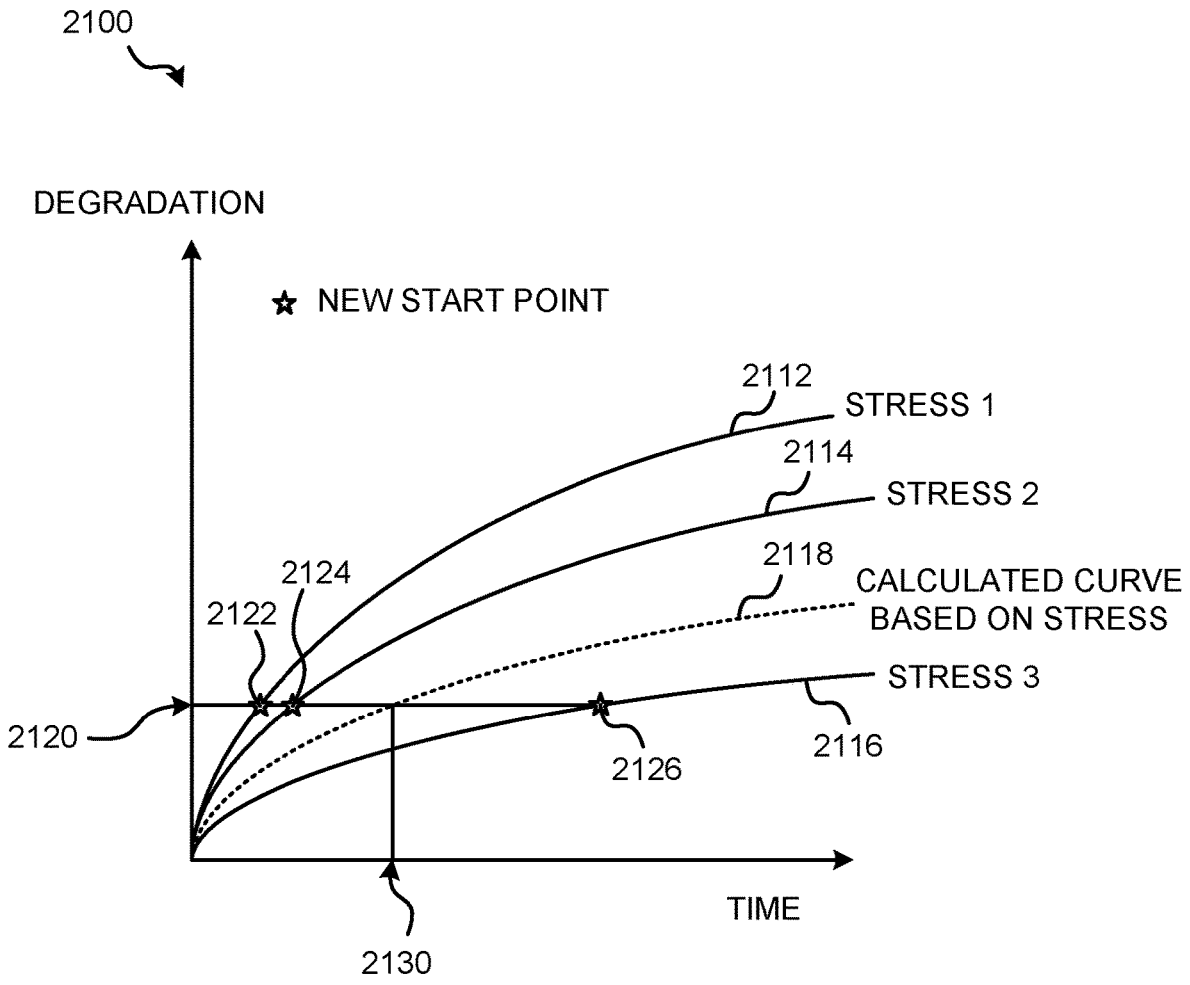
FIG. 21 depicts a set of curves for which new start points are determined for the next degradation update.

In another case, illustrated by FIG. 21, the stress history for a pixel (or group of pixels) can be reset and the start point in the interdependency curves for said pixel (or group of pixel) is shifted to the new extracted value. In some embodiments a current degradation is stored for the pixel in place of its stress history, and a stress time is tracked in place of the electrical characteristic. Instead of an interdependency curve, such an embodiment would rely on utilizing a set of degradation-time curves, each curve corresponding to various stress, temperature, initial device or other sets of operating conditions. In variations of this case, degradation or stress-time are used as the OLED parameters. Here, the time constant can be a fixed value or change depending on the stress level for each pixel.

After the degradation factor 2120 (or degradation factor as calculated from the correction factor) is updated with use of curves in calculations similar to as outlined above, either the degradation-time curve 2112, 2114, 2116 or the electrical-optical curves (not shown) corresponding to different stress conditions, the start-point of the curves can be reset for the next update. One method is finding the related x-index (e.g., stress-time) of the curve for the degradation value for each curve and using that as the new start point for those curves. For example in FIG. 21, a pixel was determined to have a related parameter "stress time" which has been determined separately to correspond to a particular value 2130 which, using the saved degradation (and in some embodiments a temporary stress history) and the calculated curve based on stress 2118, allowed extraction and calculation of the new degradation 2120. The new starting points then for the curves using the particular degradation factor 2120 correspond to 2122, 2124, and 2126. Although this method utilizing degradation-time curves dispenses with use of the OLED electrical characteristic and proceeds measuring stress time and tracking degradation, resetting of points as mentioned above may be performed in the context of interdependency curves as well. Since the degradation never "decreases" future calculations will lie along the curve which has not been discarded, and previous degradation along with the measured electrical operating parameters, temperature, and temporary stress history will serve to locate the start point from which to calculate the change in degradation at the time of the next update.

For embodiments which utilize degradation-time curves, the stress time can represent an actual time in which case a temporary stress history tracking actual stress on the pixel for a short time may be recorded. In other embodiments an effective stress time may be tracked which combines the actual stress level and time between each update for example as described hereinbelow.

Another method is to calculate the effective x-index from the stress (or temperature) level for each curve. This can be empirical or modeled for each curve, or it can be measured from different reference devices being stressed at different levels.

The new effective x-index can be used as the new start point for each curve.

The x-index could be time as shown in FIG. 21 or it can be another device parameter or temperature (or a function of a few parameters).

In one aspect, the stress history and temperature history of pixels (or group of pixels) are stored. During a status update period of the optoelectronic device, one or more interdependency curves are chosen based on temperature. Then from the stress history and selected interdependency curves a correction factor is calculated. Here, an electrical measurement from the optoelectronic device or a representative device can be used to fetch proper points from the interdependency curves.

In another aspect, the temperature is used in adjusting the stress history generating an effective stress. Here, based on the temperature and the luminance value (it can be also current, voltage or ON time) of the pixel, the effective stress is calculated. For example, if the pixel is program to offer L1, at higher temperature the "effective stress" of L1 can be similar to a "higher" stress case according to a standard of stress which does not take temperature into account.

In another aspect, if the temperature of a pixel (or a group of pixels) is significantly different from a reference temperature, the stress history calculation for said pixel (or the group of pixel) gets updated more often. In addition, the calculation for the correction factor based on the interdependency curves can also be performed more often.

In another aspect, the interdependency curves are the relation between stress time and luminance degradation of the OLED.

In another aspect, the interdependency curves are the relationship between OLED electrical characteristic and the luminance degradation of the OLED.

In another aspect, the stress history is reset to a default value after the correction factor is updated. Here, some other parameter is stored (in addition to retaining the degradation value or correction factor), to track the new origin point in the interdependency curves. For example, correction factor, time or extracted OLED parameter can be used, with the previous degradation or correction factor.

In some applications, the device performance may vary due to process variations. This can also affect the interdependency curve that a device will actually exhibit and hence affect the accuracy of calculations relying on interdependency curves which do not correspond to the device in question. It follows that the interdependency curves are a function of the initial status of the device. For example, in the case of printed OLEDs, the initial device characteristics of the OLED at different pixels or in different displays can vary due to process variation. This can also affect the aging behavior of the OLED and so influences the interdependency curve, i.e. the change in OLED electrical characteristics versus OLED efficiency degradation, exhibited by each pixel.

Figure 22:
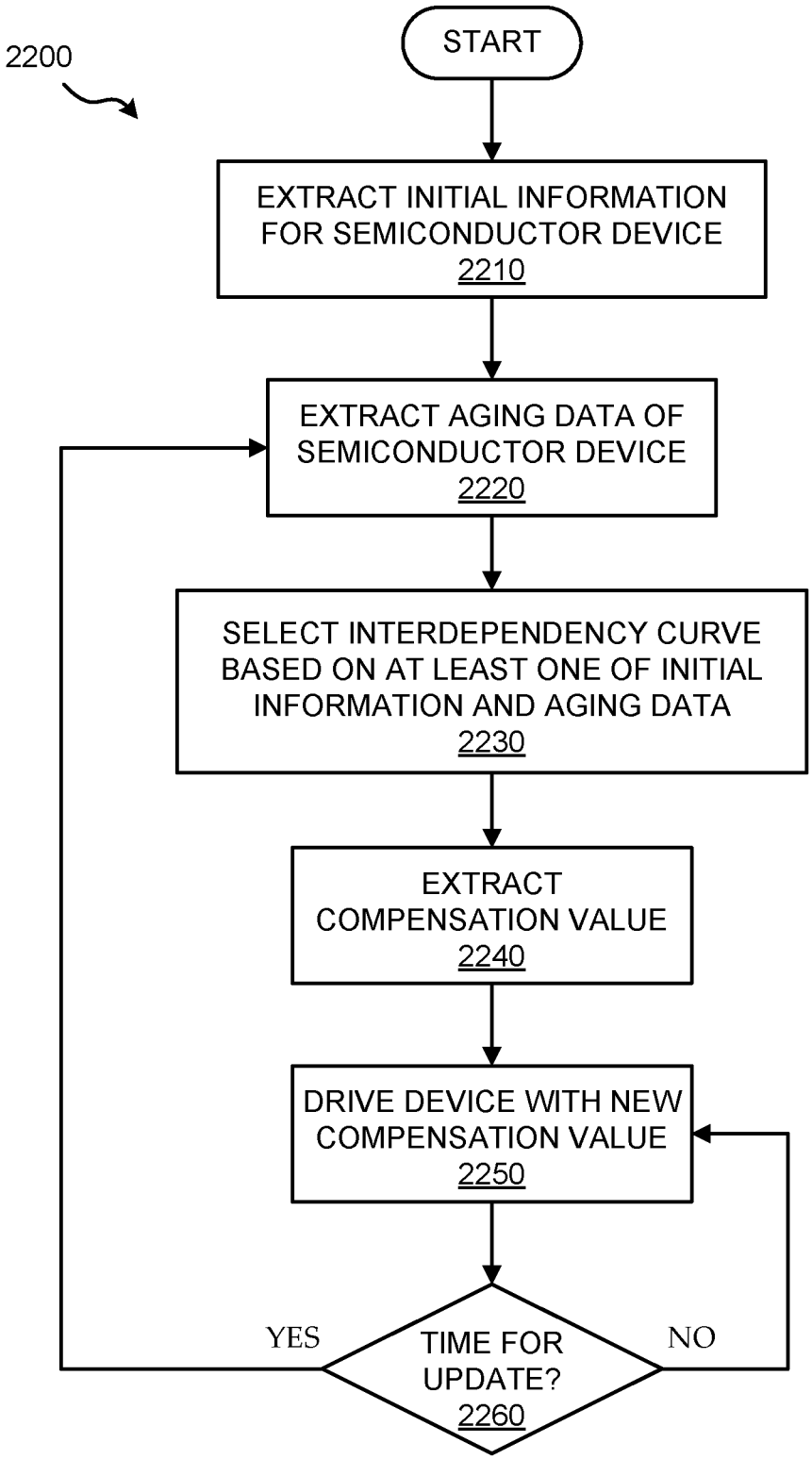
FIG. 22 is a flow chart of a procedure for incorporating initial device characteristics as an operating condition associated with the interdependency curves.

In the embodiment depicted in FIG. 22 a method 2200 for compensating a pixel based on initial device characteristics and interdependency curves first extracts information regarding the initial state or characteristics of a semiconductor device 2210. This generally should occur before the device is subjected to aging or stress in order to reflect accurately the initial state of the device. Once in operation and in need of compensation, the aging data, for example, the stress history for the pixel is then extracted for the semiconductor device 2230. The interdependency curves are chosen based on the initial status of the device and also possibly based on age or stress history 2230. A compensation value is then extracted 2240 for the device in a similar manner to that described hereinabove, utilizing the interdependency curves which have been tagged as pertaining to devices having similar initial characteristics to that of the device in question. As described, in some embodiments, a stress history is utilized to determine a compensation factor from interdependency curves of higher and lower stress conditions. The extracted compensation value is used for compensation, i.e. to drive the device 2250, until it is time for a next measurement or update cycle 2260.

Figure 23:
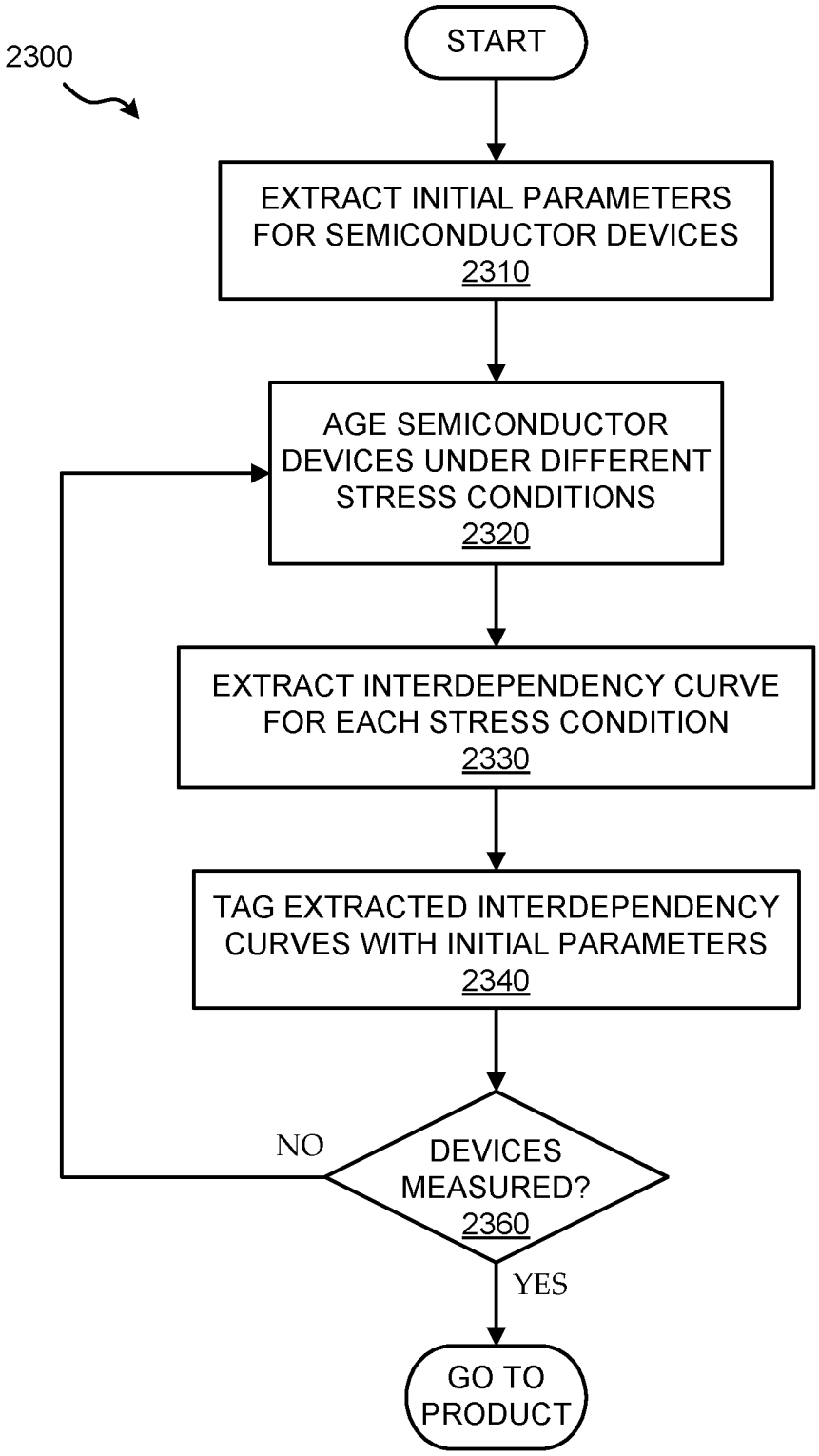
FIG. 23 is a flow chart of a procedure for extracting interdependency curves for use in compensation incorporating initial device characteristics as an operating condition.

As described above the interdependency curves include curves for various stress conditions and various initial device characteristics. With reference also to FIG. 23, in order to generate the interdependency curves for different values of initial characteristics, the devices used to extract the interdependency curves are first measured in the method 2300 for the same initial parameters which may correspond directly to specific measured characteristics or functions of them 2310. After that, the devices are aged or otherwise put under different stress conditions 2320 and the data are collected to extract the interdependency curves 2330. The interdependency curves are tagged with initial parameters 2340 until the devices are all measured 2360.

Figure 24:
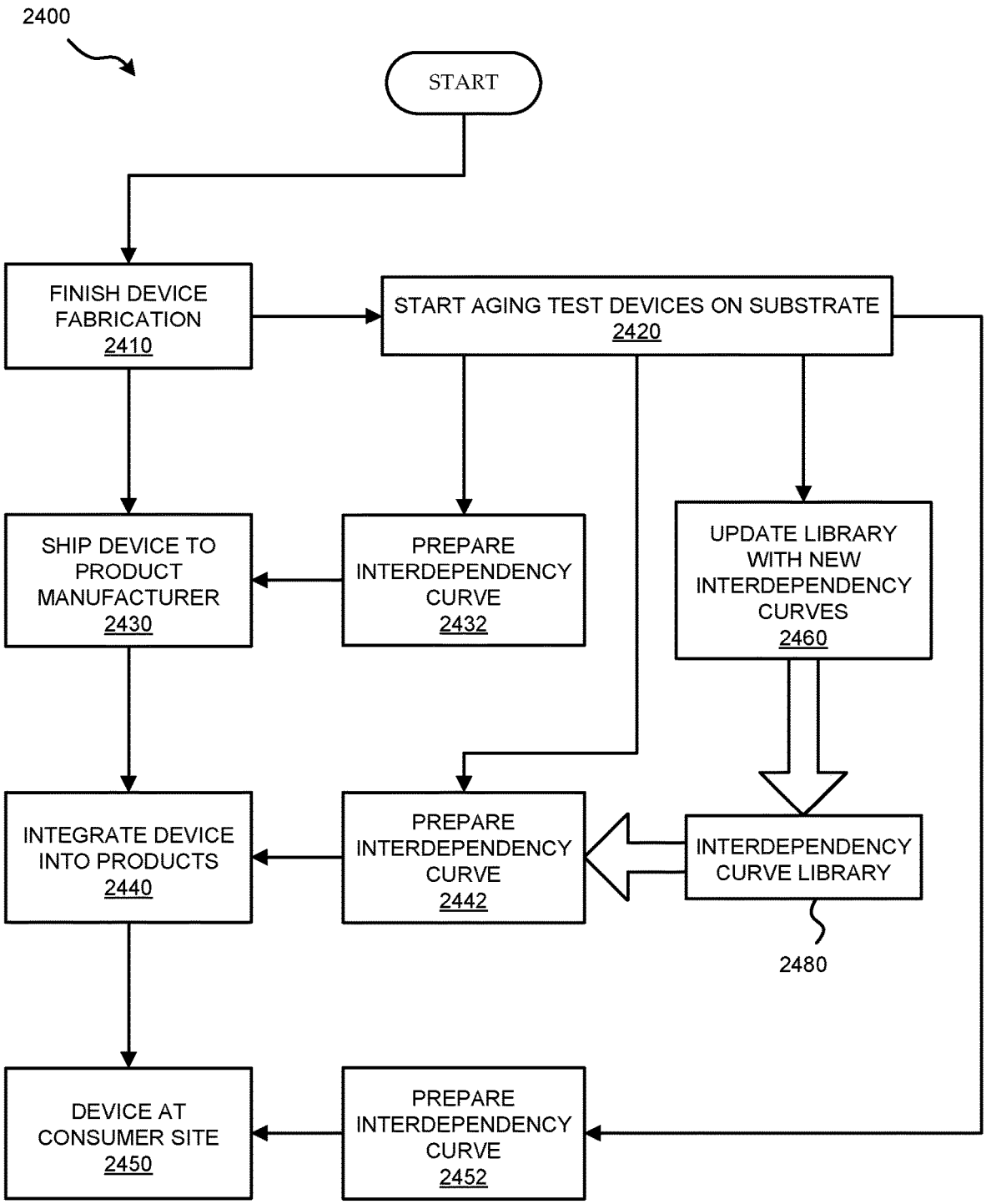
FIG. 24 is a flow chart of a procedure for updating remotely interdependency curves during product life cycle between device fabrication and the device operation at the consumer site.

Referring now to FIG. 24 a method 2400 utilized for updating interdependency curves will now be described. In some cases, the interdependency curves may vary significantly from one device (e.g., display or sensor) to another device (or from one batch to another batch). In this case, interdependency curves need to be extracted partially or entirely from the test units in the main substrates (or the main device themselves). In one case, there is a library that gets updated by every measurement and the interdependency curves are tagged with different signature parameters (which may include initial measurement). In this case, the device is shipped to the product manufacturer loaded with extracted initial interdependency curves selected from the library. These curves can be selected based on some data and measurement extracted from the panel.

In another aspect, test units go under different test conditions to extract interdependency curves directly or indirectly. In the case of indirect measurement, some parameters are extracted from the test units pointing to interdependency curves from the library. In one embodiment, test units from the same or similar batch are utilized to produce initial curves which are then utilized to select more complete curves (subjected to longer testing time) from the library.

The interdependency curves then can be updated at different stages: at product manufacturing or at a consumer site. In addition, the new data extracted may be used to update the interdependency curve library. In some embodiments updates are performed remotely, i.e. even when the device is remote from the origin of the interdependency curve library or the aging of the test devices and the preparation of the interdependency curves.

Referring specifically to the steps of the method 2400, once the device fabrication is complete 2410, test devices on a substrate are aged 2420 continually, interdependency curves are prepared. The device is shipped to the product manufacturer, for example a display with an array of OLEDs 2430. In one case aging 2420 is performed on test devices of the device itself also, in which case the prepared interdependency curves measured from that display are shipped with the device 2430. At the point in time of shipping the prepared interdependency curves may be provided to the manufacturer. In either case, the aging of the test devices continues 2420 and further interdependency curves are prepared 2442 so that by the time there is integration of the devices into the products 2440 there is another opportunity to update the shipped device with calculated interdependency curves. The aging of the test devices continues 2420 and yet further interdependency curves are prepared 2452 so that by the time the device in the product is at the consumer site 2450 there is another opportunity to update the shipped device with calculated interdependency curves. In some embodiments updates are provided over the internet. In some embodiments, preparing the interdependency curves 2432, 2442, 2452 and updating those of the shipped device at various points in time utilizes data from testing devices 2420 from the same or similar batch of devices as those that went into the product.

Optionally the process can include updating a central library with interdependency curves 2460 stored in an interdependency curve library 2480, which can collect data from multiple devices and batches of devices and serve as a comprehensive repository for similar devices and which can be used to update the interdependency curves of the shipped device at various points in time from fabrication to operation at a consumer site. In some embodiments, interdependency curves of the library 2480, each of which may for example contain data representing a many hours of stress testing, are only chosen to augment those of the shipped device when they are close a enough match to those curves already associated with the shipped device, such as for example initial interdependency curves which contain data representing fewer hours of stress testing. Although FIG. 24 depicts utilization of the interdependency curve library 2480 at the time of integration 2440 it should be understood that interdependency library 2480 may be utilized at any point in time from fabrication to the device being present at the consumer site.

Modelling can be one approach to fix the burn-in effects caused by pixel stress. However, keeping long stress histories for every pixel and also other parameters requires significant memory. Another issue is that proper modelling is very complicated due to the multi-input system with long input dynamic range. Moreover, process variations cause divergence in the real performance of the device from that predicted by the model.

Figure 25:
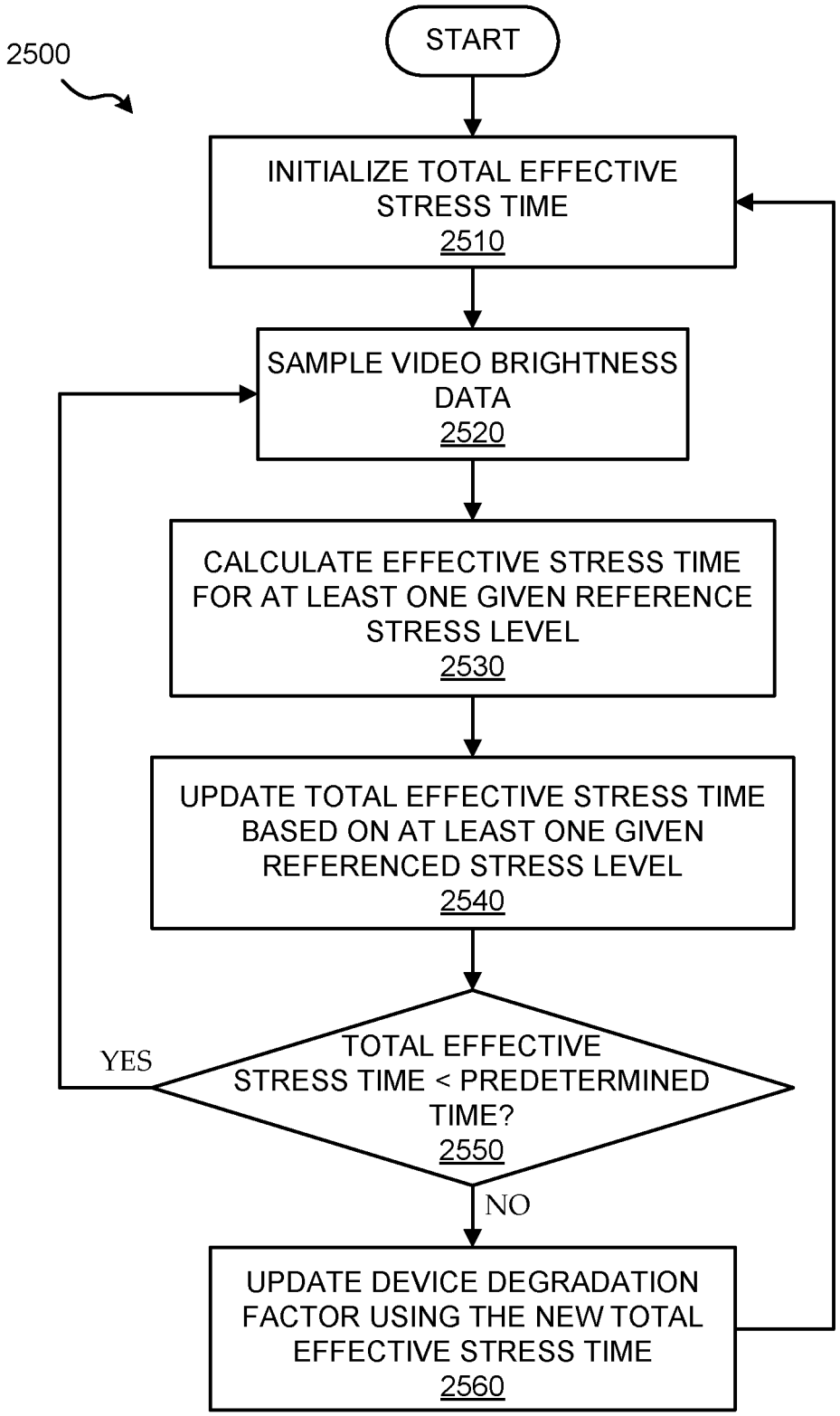
FIG. 25 is a flow chart of a simplified method of compensation utilizing interdependency or degradation-time curves and effective stress time.
Figure 26:
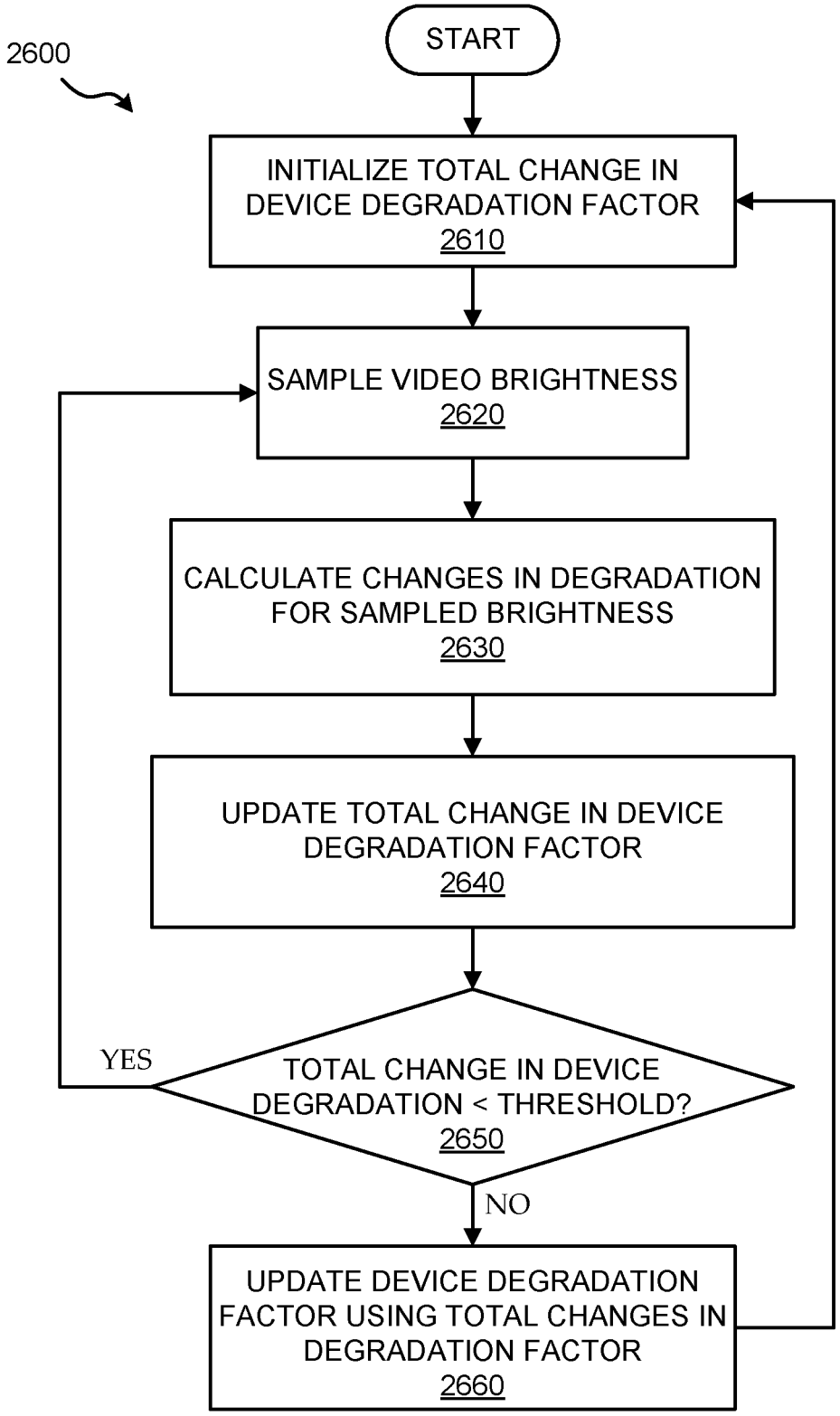
FIG. 26 is a flow chart of a simplified method of compensation utilizing interdependency or degradation-time curves and degradation.

The following embodiments illustrated in FIG. 25 and FIG. 26 addresses the above issues while offering a relatively simple approach for extracting the degradation factor (and/or correction factor) for each pixel or group of pixels.

FIG. 25 shows an embodiment which is a method of display compensation 2500 which utilizes a total effective stress time and an effective stress time to address the issues. The effective stress time is a single quantity calculated from a number of possible stress conditions as well as an actual time duration of stress under those conditions. To provide an objective quantification of the effective stress time, a reference stress is utilized which is defined by a number of operational conditions such a reference temperature and a reference stress level etc. The effective stress time is the equivalent time required for the reference stress conditions to degrade a pixel by that which the actual pixel has degraded under various actual stress conditions during an actual duration. Determination of this effective stress time in increments allows for calculation and update of a total effective stress which is tracked for the pixel between updates of the degradation factor.

First, a total effective stress time is initialized 2510. Here, the total effective stress time for each pixel or group of pixels are set to a known value (for example zero). Alternatively, after calculating the degradation value during a previous update, the remaining or residual value which otherwise would have been rounded off and lost due to the data resolution in degradation factor is used to calculate the initial value for the effective stress time.

After the total effective stress time is initialized, video brightness data is sampled 2520. In one case, after a fixed time the pixel value is sampled. The sampling time should be less than the frequency of change in the pixel data. In another case, if there is a significant change in the pixel value, the previous value and its time on the panel is used as the sampled video brightness data and the new value is used for calculating the new stress time. One can also use a combination of both.

In another case, temperature is sampled in addition to sampling the video data and time. In this case, temperature change can also be used as a trigger value for sampling the video data. For example, once the temperature change exceeds a threshold new video data is sampled.

Once the video brightness data has been sampled 2520, the effective stress time for at least one given reference stress level is calculated. Here, if one or two reference stress conditions are used, then the stress time of the pixel under sampled stress is translated to said reference conditions. For this translation, also one can use temperature as one of the translation factors. For example, the sampled video data, stress time, and temperature of the pixel are used to calculate the effective stress time for a given reference stress value, at a given temperature level 2530.

In one case, several degradation curves based on different stress and different temperature are stored. For a sampled temperature level, corresponding curves are selected. From the selected curves the conversion factor of the stress time for the sampled stress to the effective stress time of a given reference stress level is calculated. If there is no direct curve for the sampled temperature, the curves are extracted from the existing curves first. The calculation can be performed in reverse order. In this case, the curves for given sampled stress are extracted first and then the conversion factor for the temperature is calculated. Once the effective stress time for the pixel has been calculated the total effective stress for the pixel is updated 2540. The total effective stress replaces the stress history normally utilized in the process of determining from the interdependency curves the degradation factor as described hereinabove. The effective stress time therefor acts to effectively calculate the change in the total effective stress of a pixel from the various conditions contributing to effective stress since the last degradation factor update. In some embodiments, degradation-time curves are stored and utilized in the calculations. In other embodiments, a single degradation-time curve, having the single reference conditions is stored.

To simplify the calculation, one can linearize the curves around the degradation factor to calculate the change in the degradation factor for a given video data and stress time.

After some conditions are satisfied 2550 the degradation factor is updated 2560 otherwise another sample is taken 2520. These conditions can be a threshold for total effective stress time or the change in degradation factor. Here, the threshold value can be dynamic. For example, when the degradation factor changes faster, the threshold predetermined time value can be smaller to accommodate the faster degradation. The threshold parameters' value for this decision can be different for each pixel. In some embodiments, the threshold is set to ensure that only once the total effective stress time has accumulated by an amount having a magnitude of sufficient significance, is the degradation factor updated. As mentioned above any residual which would be rounded off can be used as the value to initialize the total effective stress time during the next update.

In updating the degradation factor 2560, from the effective stress time and the previous degradation factor, the change in degradation is calculated. After updating the change in degradation, the degradation factor itself is updated. In one case, after the degradation factor is calculated, the error due to quantization and other factors is calculated to be used as part of the calculation of the new initial value for the total effective stress time.

FIG. 26 shows an embodiment of a method 2600 for updating the degradation factor without relying upon effective stress time calculations, but rather estimating the direct effect various operating conditions and stresses have on degradation.

First, the total change in degradation factor is initialized 2610. Here, the change in the degradation factor for each pixel or group of pixels are set to a known value (for example zero). Alternatively, after calculating the degradation value of a previous update, the remaining or residual value due to the resolution in the degradation factor which otherwise would have been rounded off during the last update is used to initialize the total change in degradation factor.

After the change in degradation factor is initialized, video brightness is sampled 2620. In one case, after a fixed time the pixel value is sampled. The sampling time should be less than the frequency of change in the pixel data. In another case, if there is a significant change in the pixel value, the previous value and its time on the panel is used as the sampled video brightness data and the new value is used. One can also use a combination of both. In another case, temperature is sampled in addition to sampling the video data and time. In this case, temperature change can also be used as a trigger value for sampling the video data. For example, once the temperature change exceeds a threshold new video data is sampled.

Once the video brightness data has been sampled 2620, a resulting change in degradation factor is calculated 2630. For example, the sampled video data, stress time, degradation factor, and temperature are used to calculate the change in the degradation factor.

In one case, several degradation curves based on different stress and different temperature are stored. For a sampled temperature level, corresponding curves are selected. From the selected curves, the change in degradation factor can be calculated based on the degradation factor, the sampled stress, and stress time. If there is no direct curve for the sampled temperature, the curves are extracted from the existing curves first. The calculation can be performed in reverse order. In this case, the curves for given sampled stress are extracted first and then the change in the degradation factor for the temperature is calculated. In a similar manner to embodiments described hereinabove, histories of the pixel are discarded by adopting new starting points for the degradation-time or interdependency curves. As such a degradation factor is stored for each pixel i.e. OLED, and updated.

To simplify the calculation, one can linearize the curves around the degradation factor to calculate the change in the degradation factor for a given video data and stress time.

After some conditions are satisfied 2650 the degradation factor is updated 2560 otherwise another sample is taken 2620. These conditions can be a threshold for the change in degradation factor. Here, the threshold value can be dynamic. For example, when the degradation factor changes faster, the degradation threshold value can be smaller to accommodate the faster degradation. The threshold parameters' value for this decision can be different for each pixel.

In updating the degradation factor 2660, the change in degradation factor is added to the degradation factor. In one case, after the new degradation factor is calculated, the error due to quantization and other factors is calculated to be used as the initial value for change in the degradation factor. In some embodiments, the threshold is set to ensure that only once the total change in device degradation has accumulated by an amount having a magnitude of sufficient significance, is the degradation factor updated. As mentioned above any residual which would be rounded off can be used as the value to initialize the total change in device degradation during the next update.

Compensation for OLED efficiency degradation based on electrical characteristics of the OLED devices is prone to error due to different aging conditions. One solution is to keep history of the aging, for example stress and temperature histories, of each pixel (or a group of the pixel). This may require significant memory size. To address that, event driven stress history was developed which reduces the memory size significantly. Further, to reduce the system complexity and eliminate the need for memory, the new embodiment uses the rate of change in the OLED characteristic as an indicator for correcting the aging of the OLED.

$$\text{OLED correction}=f(V_{OLED} \text{ or } I_{OLED}, V_{OLED}/dt \text{ or } dI_{OLED}/dt)$$

Here, different interdependency curves can be used for correcting the OLED efficiency degradation. To select the curve, one can use the rate of change. The higher the aging rate at a certain aging point can be an indicator of the stress status.

Although the above shows the function specifically with respect to voltage or current and the change in voltage or current other parameters of an interdependency curve may be used.

While particular embodiments, aspects, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

The invention claimed is:

1. A method of compensating degradation of an organic light emitting device (OLED) in an array-based semiconductor device having arrays of pixels that include OLEDs, said method comprising:

determining operating conditions for the OLED with respect to at least two of temperature condition, stress condition, initial characteristics, and age condition;

measuring an electrical operating parameter of said OLED;

determining degradation of said OLED using said operating conditions for the OLED, said measured electrical operating parameter, and two sets of interdependency curves, each curve directly relating changes in the electrical operating parameter of said OLEDs and the luminance degradation of said OLEDs in said array-based semiconductor device, each set of interdependency curves based on a different operating condition;

determining a correction factor for the OLED with use of said degradation; and compensating for said degradation with use of said correction factor.

2. The method according to claim 1, further comprising:

determining, for the plurality of operating conditions, interdependency curves, each curve directly relating changes in the electrical operating parameter of said OLEDs and the luminance degradation of said OLEDs in said array-based semiconductor device.

3. The method according to claim 2, wherein each interdependency curve has an associated temperature condition and a stress condition, and wherein determining the degradation comprises:

determining at least one temperature associated interdependency curve with use of said temperature; and determining from said at least one temperature associated interdependency curve and a stress level and said measured electrical operating parameter, the degradation of the OLED.

4. The method according to claim 1, wherein after the correction factor for the OLED has been determined, a start point associated with the interdependency curves is reset.

5. The method according to claim 1, further comprising:

determining, for a plurality of effective stress levels in the stress history, which factor in temperature, interdependency curves, or at least a plurality of points of interest, directly relating changes in the electrical operating parameter of said OLEDs and the luminance degradation of said OLEDs in said array-based semiconductor device.

6. The method according to claim 1, wherein determining for a plurality of operating conditions interdependency curves comprises:

extracting initial characteristics for each of a plurality of test OLEDs;

repeatedly subjecting the test OLEDs to different stress conditions until all test OLEDs are measured; and extracting interdependency curves for said test OLEDs and storing said interdependency curves such that each interdependency curve is associated with at least one stress condition and an initial device characteristic condition.

7. The method according to claim 6, further comprising:

updating remotely a set of interdependency curves stored with the array-based semiconductor device with a set of prepared interdependency curves from a remote interdependency curve library at least twice after fabrication of the array-based semiconductor device.

8. The method according to claim 7, wherein the updating remotely occurs at the time of at least two of: shipping the array-based semiconductor device to the manufacturer, integrating the array-based semiconductor device into a product, and operation of the array-based semiconductor device at a consumer site.

9. The method according to claim 1, wherein determining the efficiency degradation comprises:

initializing a total effective stress time value;

sampling brightness data for said OLED;

calculating an effective stress time corresponding to said sampling for at least one given reference stress level;

updating the total effective stress time for said OLED based on the at least one given stress level;

determining whether to sample more brightness data; and in a case no more brightness data are to be sampled, updating the efficiency degradation with use of the total effective stress, and the interdependency curves.

10. The method according to claim 9, wherein determining whether to sample more brightness data comprises comparing the total effective stress time with a predetermined threshold.

11. The method according to claim 1, wherein determining the efficiency degradation comprises:

initializing a total change in degradation factor;

sampling brightness data for said OLED;

calculating a change in degradation corresponding to the sampled brightness; updating the total change in degradation factor for said OLED;

determining whether to sample more brightness data; and in a case no more brightness data are to be sampled, updating the efficiency degradation with use of the total change in degradation factor, and the interdependency curves.

12. The method according to claim 11, wherein determining whether to sample more brightness data comprises comparing the total change in degradation factor with a predetermined change in degradation threshold.

13. A method of compensating degradation of an organic light emitting device (OLED) in an array-based semiconductor device having arrays of pixels that include OLEDs, said method comprising:

determining an effective stress for the OLED in respect of a stress condition and a temperature condition;

measuring an electrical operating parameter of said OLED;

determining degradation of said OLED using said temperature condition for the OLED, said measured electrical operating parameter, and a set of interdependency curves, or at least a plurality of points of interest, directly relating changes in the electrical operating parameter of said OLEDs and the luminance degradation of said OLEDs in said array-based semiconductor device, the set of interdependency curves based on effective stress conditions, which is calculated using both a temperature history and a stress history of the OLED;

determining a correction factor for the OLED with use of said degradation; and compensating for said degradation with use of said correction factor.

14. The method according to claim 13, wherein after the correction factor for the OLED has been determined, a start point associated with the interdependency curves is reset.

15. The method according to claim 13, wherein each interdependency curve has an associated effective stress history as a function of at least the temperature condition and the stress condition, and wherein determining an efficiency degradation comprises:

determining an effective stress history for the OLED with use of the temperature history and the stress history; and determining from said interdependency curves and said effective stress history and said measured electrical operating parameter the efficiency degradation of the OLED.

16. A method of compensating for degradation of an organic light emitting device (OLED) in an array-based semiconductor device having arrays of pixels that include OLEDs, said method comprising:

determining for each of a plurality of operating conditions at least one degradation-time curve, each curve directly relating changes in a stress time parameter associated with said OLEDs and the luminance degradation of said OLEDs in said array-based semiconductor device, the plurality of operating stress conditions comprising at least two operating conditions selected from stress, temperature, and initial device characteristics;

measuring at least one operating condition for the OLED;

determining a degradation of said OLED using said each set of degradation-time curves, and said at least one operating condition for the OLED;

determining a correction factor for the OLED with use of said degradation; and compensating for said degradation with use of said correction factor.

17. The method according to claim 16, wherein after the correction factor for the OLED has been determined, a start point associated with the at least one degradation-time curve is reset.

18. The method according to claim 16, wherein determining the efficiency degradation comprises:

initializing a total effective stress time value;

sampling brightness data for said OLED;

calculating an effective stress time corresponding to said sampling for at least one given reference stress level;

updating the total effective stress time for said OLED based on the at least one given stress level;

determining whether to sample more brightness data; and in a case no more brightness data are to be sampled, updating the degradation with use of the total effective stress, and the at least one degradation-time curve.

19. The method according to claim 16, wherein determining the efficiency degradation comprises:

initializing a total change in degradation factor;

sampling brightness data for said OLED;

calculating a change in degradation corresponding to the sampled brightness;

updating the total change in degradation factor for said OLED;

determining whether to sample more brightness data; and in a case no more brightness data are to be sampled, updating the degradation with use of the total change in degradation factor, and the at least one degradation-time curve.

* * * * *